US011492744B2

(12) United States Patent
Kim et al.

(10) Patent No.: US 11,492,744 B2
(45) Date of Patent: Nov. 8, 2022

(54) ELECTRONIC DEVICE AND METHOD FOR CONTROLLING THE SAME

(71) Applicant: Samsung Electronics Co., Ltd, Suwon-si (KR)

(72) Inventors: Bo-bin Kim, Seongnam-si (KR); Hae-yoon Park, Seoul (KR); Jung-ah Seung, Guri-si (KR); Min-ji Park, Bucheon-si (KR); Kyoung-ae Lim, Seongnam-si (KR); Jae-jeong Kim, Seoul (KR); Ji-yoon Yoon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 395 days.

(21) Appl. No.: 16/643,338

(22) PCT Filed: Aug. 24, 2018

(86) PCT No.: PCT/KR2018/009795
§ 371 (c)(1),
(2) Date: Feb. 28, 2020

(87) PCT Pub. No.: WO2019/045373
PCT Pub. Date: Mar. 7, 2019

(65) Prior Publication Data

US 2021/0062385 A1 Mar. 4, 2021

(30) Foreign Application Priority Data

Aug. 30, 2017 (KR) ..... 10-2017-0110377
Jul. 27, 2018 (KR) ..... 10-2018-0087559

(51) Int. Cl.
*D06F 58/36* (2020.01)
*D06F 34/32* (2020.01)
(Continued)

(52) U.S. Cl.
CPC ..... *D06F 34/32* (2020.02); *D06F 33/32* (2020.02); *D06F 33/44* (2020.02); *D06F 33/52* (2020.02);
(Continued)

(58) Field of Classification Search
CPC ..... D06F 34/32; D06F 34/05; D06F 34/18; D06F 33/32; D06F 33/44; D06F 33/52;
(Continued)

(56) References Cited

U.S. PATENT DOCUMENTS 7,661,168 B2 2/2010 Kim
9,303,350 B2 4/2016 Park et al.
(Continued)

FOREIGN PATENT DOCUMENTS

CN 103502522 A 1/2014
CN 106702661 A 5/2017
(Continued)

OTHER PUBLICATIONS

Supplementary European Search Report in connection with European Application No. 18849663.2 dated Jul. 10, 2020, 7 pages.
(Continued)

*Primary Examiner* — John P McCormack

(57) ABSTRACT

Disclosed is an electronic device. The electronic device comprises: a display and a processor, wherein, when at least one condition among the time required to treat an object and an object treatment completion time is input, the processor identifies a plurality of object treatment courses that comply with the condition, identifies the order of priority of the plurality of object treatment courses according to predetermined criteria, and controls the display to provide a list listing information about the plurality of object treatment courses on the basis of the identified order of priority, wherein the object treatment is a process in which an object
(Continued)

is cleaned or dried by means of at least one among a cleaning operation and a drying operation.

15 Claims, 25 Drawing Sheets

(51) Int. Cl.

| | |
|---|---|
| ***D06F 34/05*** | (2020.01) |
| ***D06F 33/70*** | (2020.01) |
| ***D06F 33/44*** | (2020.01) |
| ***D06F 33/32*** | (2020.01) |
| ***D06F 33/52*** | (2020.01) |
| ***D06F 58/46*** | (2020.01) |
| *D06F 101/06* | (2020.01) |
| *D06F 105/52* | (2020.01) |
| *D06F 105/58* | (2020.01) |
| *D06F 105/56* | (2020.01) |

(52) U.S. Cl.
CPC ..... *D06F 33/70* (2020.02); *D06F 34/05* (2020.02); *D06F 58/36* (2020.02); *D06F 58/46* (2020.02); *D06F 2101/06* (2020.02); *D06F 2105/52* (2020.02); *D06F 2105/56* (2020.02); *D06F 2105/58* (2020.02)

(58) Field of Classification Search
CPC ..... D06F 33/70; D06F 33/68; D06F 58/36; D06F 58/46; D06F 58/34; D06F 2101/06; D06F 2101/00; D06F 2101/02; D06F 2101/20; D06F 2101/14; D06F 2105/52; D06F 2105/56; D06F 2105/58; D06F 2105/60; D06F 2103/02; D06F 2103/38
USPC ..... 8/137; 700/208, 296
See application file for complete search history.

(56) References Cited

U.S. PATENT DOCUMENTS

| | | | | |
|---|---|---|---|---|
| 9,739,004 | B2 | 8/2017 | Ha et al. | |
| 2004/0134238 | A1* | 7/2004 | Buckroyd | D06F 34/32 68/12.23 |
| 2012/0084995 | A1* | 4/2012 | Vogel | D06F 58/48 34/492 |
| 2012/0330442 | A1 | 12/2012 | Hwang et al. | |
| 2014/0018962 | A1* | 1/2014 | Jung | D06F 34/28 700/275 |
| 2014/0058553 | A1* | 2/2014 | Lee | D06F 37/42 700/143 |
| 2015/0345068 | A1 | 12/2015 | Coffman et al. | |
| 2017/0284009 | A1* | 10/2017 | Lv | D06F 34/28 |

FOREIGN PATENT DOCUMENTS

| | | | | | |
|---|---|---|---|---|---|
| EP | 2876194 | A1 * | 5/2015 | ..... | D06F 33/02 |
| JP | 2005-034412 | A | 2/2005 | | |
| JP | 2014-033765 | A | 2/2014 | | |
| KR | 10-2004-0046925 | A | 6/2004 | | |
| KR | 20080079913 | A * | 9/2008 | ..... | D06F 33/02 |
| KR | 10-2010-0052207 | A | 5/2010 | | |
| KR | 10-2010-0062703 | A | 6/2010 | | |
| KR | 10-2012-0086032 | A | 8/2012 | | |
| KR | 10-2012-0100178 | A | 9/2012 | | |
| KR | 10-1381144 | B1 | 4/2014 | | |
| KR | 10-2015-0019209 | A | 2/2015 | | |
| KR | 10-2015-0118749 | A | 10/2015 | | |

OTHER PUBLICATIONS

Communication pursuant to Article 94(3) EPC dated Dec. 11, 2020 in connection with European Patent Application No. 18 849 663.2, 4 pages.
International Search Report dated Nov. 26, 2018 in connection with International Patent Application No. PCT/KR2018/009795, 2 pages.
Written Opinion of the International Searching Authority dated Nov. 26, 2018 in connection with International Patent Application No. PCT/KR2018/009795, 4 pages.
Communication pursuant to Article 94(3) EPC dated Aug. 19, 2021, in connection with European Application No. 18849663.2, 4 pages.
China National Intellectual Property Administration, "The First Office Action," dated May 26, 2022, in connection with Chinese Patent Application No. 201880068258.1, 21 pages.

* cited by examiner

FIG. 6D

| 660 | 670 | 680 | 690 |
|---|---|---|---|
| ORDINARY | UNDER WEAR | SPORTS WEAR | SLEEPING GEAR |
| T-SHIRT | LINGERIE | GYM SUIT | TOWEL |
| SHIRT | BRASSIERE | MOUNTAIN SPORTSWEAR | DUVET COVER |
| BLOUSE | PANTIES | SWIMMING SUIT | BED SHEET |
| CARDIGAN | | SKIWEAR | CURTAIN |
| SWEATER | | | |
| OTHER KNITS | | | |
| BLUE JEAN | | | |
| OTHER PANTS | | | |
| STOCKINGS | | | |
| SCARF | | | |
| SOCKS | | | |
| CAP | | | |

ELECTRONIC DEVICE AND METHOD FOR CONTROLLING THE SAME

CROSS-REFERENCE TO RELATED APPLICATIONS

This application is a 371 of International Application No. PCT/KR2018/009795 filed on Aug. 24, 2018, which claims priority to Korean Patent Application No. 10-2017-0110377 filed on Aug. 30, 2017, and Korean Patent Application No. 10-2018-0087559 filed on Jul. 27, 2018, the disclosures of which are herein incorporated by reference in their entirety.

FIELD

The disclosure relates to an electronic device that recommends and provides washing courses or drying courses, and a method for controlling the same.

DESCRIPTION OF RELATED ART

In general, a washing machine applies an impact to a laundry to separate a contaminant from the laundry, and a drying machine is a device that dries the laundry by removing moisture of the laundry whose washing is completed.

In such a washing machine, a plurality of washing courses programmed by appropriately setting washing conditions and the like including washing, rinsing, and dewatering times according to a weight of the laundry are stored in a memory. Therefore, when a use directly chooses a washing course, the washing machine performs a washing operation corresponding to the chosen washing course, and the drying machine also performs a drying operation according to a chosen drying course.

However, recently, a new cloth has emerged, and kinds of clothes have also become diverse, such that washing and drying conditions have been complicated. Accordingly, a user thinks about in which of the courses provided by a conventional washing machine and drying machine he/she is to perform the washing and drying operations. Therefore, there was a problem that it is difficult to satisfy needs of users that have gradually subdivided and diversified.

The disclosure has been made in view of the necessity described above, and an object of the disclosure is to provide an electronic device that provides a list in which information on washing or drying courses is listed according to priorities on the basis of an input washing or drying condition, and a method for controlling the same.

SUMMARY

According to an embodiment of the disclosure, an electronic device includes: a display; and a processor configured to identify a plurality of object treating courses meeting an input condition when at least one of a condition for an object treatment required time or a condition for an object treatment completion time is input, identify priorities of the plurality of object treating courses according to a predetermined criterion, and control the display to provide a list in which information on the plurality of object treating courses is listed on the basis of the identified priorities, wherein object treatment is a process of washing or drying the object by at least one of a washing operation or a drying operation.

The processor may be configured to update the list by removing at least some object treating courses from the list on the basis of an additional condition when the additional condition is input, the additional condition being an additional condition for at least one of a kind of object, a color of the object, or a soil of the object.

The processor may be configured to update the list by reordering an order of the plurality of object treating courses on the basis of an additional condition when the additional condition is input, the additional condition being an additional condition for at least one of a kind of object, a color of the object, or a soil of the object.

The processor may be configured to update the list by removing at least some object treating courses from the list or reordering an order of the plurality of object treating courses on the basis of an additional condition when the additional condition is input, the additional condition being an additional condition for at least one of information related to consumed energy or information related to a damage degree of the object.

The processor may be configured to identify the priorities of the plurality of object treating courses on the basis of object treatment required times of each of the plurality of object treating courses.

The processor may be configured to provide an animation image representing an object treatment status on the basis of information on the object treatment status when an object treating course is chosen on the list and object treatment according to the chosen object treating course is started.

The processor may be configured to provide an animation image that includes a progress bar guiding a remaining object treatment required time on the basis of an object treatment required time of the object treating course and an object treating progress time at a current point in time and color information.

The processor may be configured to provide a summed time of the washing operation and the drying operation according to each object course on the display when the plurality of object treating courses meeting the condition are identified. The processor may be configured to identify object treating courses regarding the drying operation on the basis of a chosen object treating course when one of the plurality of object treating courses regarding the washing operation is chosen, and provide a list in which information on the identified object treating courses regarding the drying operation is listed, on the display.

The processor may be configured to provide a user interface (UI) including items representing kinds of different objects, and provide a guide for adding a kind of object on the basis of a kind of specific object when an item representing the kind of specific object is chosen on the UI.

The electronic device may be implemented by a user terminal device communicating with at least one of a washing machine or a drying machine performing the object treatment.

According to another embodiment of the disclosure, a method for controlling an electronic device includes: identifying a plurality of object treating courses meeting an input condition when at least one of a condition for an object treatment required time or a condition for an object treatment completion time is input; identifying priorities of the plurality of object treating courses according to a predetermined criterion; and providing a list in which information on the plurality of object treating courses is listed on the basis of the identified priorities, wherein object treatment is a process of washing or drying the object by at least one of a washing operation or a drying operation.

The method may further include: receiving an input of an additional condition for at least one of a kind of object, a color of the object, or a soil of the object; and updating the list by removing at least some object treating courses from the list on the basis of the additional condition.

The method may further include: receiving an input of an additional condition for at least one of a kind of object, a color of the object, or a soil of the object; and updating the list by reordering an order of the plurality of object treating courses on the basis of the additional condition.

The method may further include: receiving an input of an additional condition for at least one of information related to consumed energy or information related to a damage degree of the object; and updating the list by removing at least some object treating courses from the list or reordering an order of the plurality of object treating courses on the basis of the additional condition.

In the identifying of the priorities, the priorities of the plurality of object treating courses may be identified on the basis of object treatment required times of each of the plurality of object treating courses.

The method may further include providing an animation image representing an object treatment status on the basis of information on the object treatment status when an object treating course is chosen on the list and object treatment according to the chosen object treating course is started.

In the providing of the animation image, the animation image that includes a progress bar guiding a remaining object treatment required time on the basis of an object treatment required time of the object treating course and an object treating progress time at a current point in time and color information may be provided.

The method may further include providing a summed time of the washing operation and the drying operation according to each object course when the plurality of object treating courses meeting the condition are identified.

The method may further include: identifying object treating courses regarding the drying operation on the basis of a chosen object treating course when one of the plurality of object treating courses regarding the washing operation is chosen; and providing a list in which information on the identified object treating courses regarding the drying operation is listed.

As set forth above, according to diverse embodiments of the disclosure, only by the input of a washing condition or a drying condition by a user, the electronic device displays a list recommending the washing courses and the drying courses, and convenience of the user is thus improved.

BRIEF DESCRIPTION OF THE DRAWINGS

FIGS. 6A to 6D are views illustrating screens for setting a condition for kinds of objects according to an embodiment of the disclosure.

DETAILED DESCRIPTION

Figure 1:
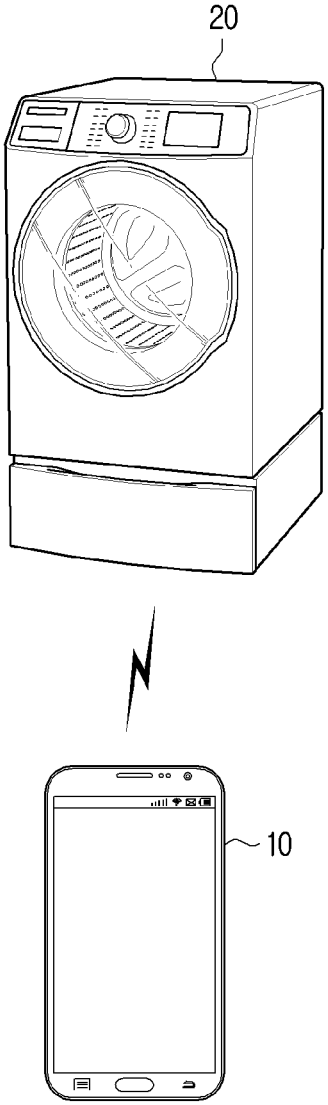
FIG. 1 is a schematic view for describing a system including an object treating device and a user terminal device according to an embodiment of the disclosure.

Hereinafter, the disclosure will be described in detail with reference to the drawings. In describing the disclosure, when it is determined that a detailed description for the known functions or configurations related to the disclosure may unnecessarily obscure the gist of the disclosure, the detailed description therefor will be omitted. In addition, the following embodiments may be modified in several different forms, and the scope and spirit of the disclosure are not limited to the following embodiments. Rather, these embodiments make the disclosure thorough and complete, and are provided to completely transfer a technical spirit of the disclosure to those skilled in the art.

In addition, a phrase 'including any component' will be understood to imply the inclusion of other components rather than the exclusion of other component, unless explicitly described otherwise. Further, various elements and regions in the drawings are schematically illustrated. Therefore, the technical spirit of the disclosure is not limited by relative sizes or intervals illustrated in the accompanying drawings.

Hereinafter, the disclosure will be described in detail with reference to the accompanying drawings.

FIG. 1 is a schematic view for describing a system including an object treating device and a user terminal device according to an embodiment of the disclosure.

A user terminal device 10 recommends and provides washing or drying courses on the basis of a washing or drying condition input by a user. For example, the user terminal device 10 may be implemented by a smart phone. However, the user terminal device 10 is not limited thereto, and may be any device that includes a display capable of providing information on recommended washing or drying courses. For example, the user terminal device 10 may be implemented by various electronic devices such as a remote controller, a tablet personal computer (PC), a television (TV), and a PC.

An object treating device 20 may be at least one of a washing machine 20-1 or a drying machine 20-2.

The object treating device 20 may be implemented to perform a washing operation or a drying operation on the basis of information received from the user terminal device 10. For example, the washing machine 20-1 may be implemented by a pulsator washing machine that performs washing with a water current generated by rotating a pulsator having a disk shape, an agitator washing machine that performs washing by rotating an agitator erecting at the center of a washing tub and having a wing shape leftward and rightward, a drum washing machine that performs washing by dropping a laundry by rotation of a drum to apply an impact to the laundry, or the like. In addition, the washing machine 20-1 may also be implemented as a washing machine having an object drying function. The drying machine 20-2 is a device that dries an object to be dried, and may be implemented as an electric drying machine, a gas drying machine, or the like.

Here, the object is all things that are washing or drying objects, and may include, for example, clothes, bedclothes, hats, sneakers, and the like, but is not limited thereto.

In particular, the user terminal device 10 according to an embodiment of the disclosure may provide a user interface (UI) screen in which recommended washing courses or drying courses are listed according to priorities on the basis of the washing or drying condition input by the user, and provide information on a washing course or a drying course chosen through the UI screen to the washing machine 20-1 or the drying machine 20-2. Hereinafter, UI screens provided according to various embodiments of the disclosure will be described in detail with reference to the drawings.

Figure 2A:
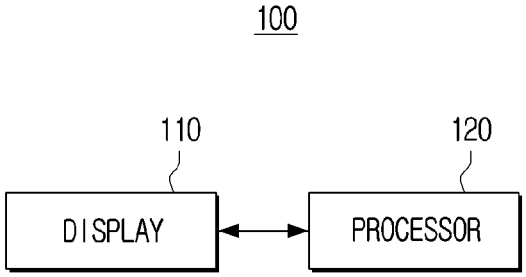
FIGS. 2A and 2B are block diagrams illustrating components of an electronic device according to an embodiment of the disclosure.
Figure 2B:
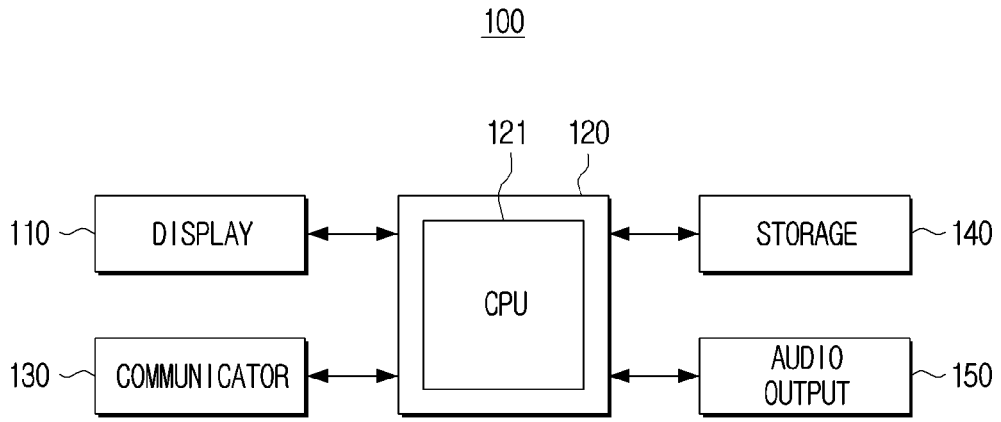

FIGS. 2A and 2B are block diagrams illustrating components of an electronic device according to an embodiment of the disclosure.

According to FIG. 2A, an electronic device 100 includes a display 110 and a processor 120. Here, the electronic device 100 may be implemented by the user terminal device 10 of FIG. 1. However, in some cases, the electronic device 100 may also be implemented by the object treating device 20 of FIG. 1. For example, various UIs to be described below may be provided on the user terminal device 10 or the object treating device 20 of FIG. 1. However, hereinafter, for convenience of explanation, a case where the electronic device 100 is implemented by the user terminal device 10 of FIG. 1 will be described.

The display 110 displays a UI for receiving an input for a washing condition or a drying condition.

The display 110 may be implemented in various forms such as a liquid crystal display (LCD), an organic light emitting diode (OLED), a liquid crystal on silicon (LCoS), a digital light processing (DLP) projector, a quantum dot (QD) display panel, and the like.

The processor 120 controls a general operation of the electronic device 100.

According to an embodiment, the processor 120 may be implemented by a digital signal processor (DSP), a microprocessor, or a time controller (TCON) that processes a digital signal. However, the processor 120 is not limited thereto, but may include one or more of a central processing unit (CPU), a micro controller unit (MCU), a micro processing unit (MPU), a controller, an application processor (AP), a communication processor (CP), and an ARM processor, or may be defined by these terms. In addition, the processor 120 may be implemented by a system-on-chip (SoC) or a large scale integration (LSI) in which a processing algorithm is embedded or may be implemented in a field programmable gate array (FPGA) form.

When at least one of a condition for an object treatment required time or a condition for an object treatment completion time is input, the processor 120 may identify a plurality of object treating courses that meet the input condition, and provide a list in which information on the plurality of object treating courses is listed, on the display 110. In this case, the processor 120 may identify priorities of the plurality of object treating courses according to a predetermined criterion, and provide the list in which the information on the plurality of object treating courses is listed on the basis of the identified priorities. The predetermined criterion may be an order in which the object treatment required time is short, an order in which the object treatment required time is long, an order in which an object treating effect is good, or an order in which damage to the object is low, but is not limited thereto. Here, the object treatment required time refers to a time from an object treatment start point in time to an object treatment completion point in time. The object treatment completion time refers to a point in time when object treatment is completed.

Here, the object treatment may be a process of washing or drying the object by a washing operation, a drying operation, or a washing and drying operation.

The predetermined criterion may be set to a default or may be changed or set by a choice of the user. Alternatively, the predetermined criteria may be set according to an object treating course choice history. For example, the processor 120 may set the predetermined criterion by analyzing an object treating course whose choice frequency of the user is high among a plurality of object treating (washing) courses on the basis of the object treating course choice history of the user. As an example, in a case where the user frequently chooses a course in which an object treatment required time is long among the plurality of object treating (washing) courses, the processor 120 may set the predetermined criterion to the order in which the object treatment required time is long.

When the condition for the object treatment required time is input, the processor 120 may identify the plurality of object treating courses on the basis of the condition for the object treatment required time. For example, when 'one hour and a half' is input as a washing required time, the processor 120 may identify a washing course in which a washing time within one hour and a half is required. As an example, the processor 120 may identify a 'quick wash course' in which 15 minutes are required, a 'delicates course' in which 30 minutes are required, a 'super speed course' in which 39 minutes are required, and a 'daily wash course in which one hour and six minutes are required. However, the numerical values for each washing course are mere examples, and are not limited.

Subsequently, the processor 120 may list the plurality of object treating courses from an object treating course in which an object treatment required time is short according to the predetermined criterion, or may list the plurality of object treating courses from an object treating course in which an object treatment required time is closest to an input object treatment required time, that is, an object treating course in which an object treatment required time is longest among the identified object treating courses. When one of the recommended object treating courses is chosen, the processor 120 may provide information on the chosen object treating course to the object treating device 20. However, in a case where the electronic device 100 is implemented by the washing machine 20-1 or the drying machine 20-2 capable of treating an object, a washing operation or a drying operation may be started on the basis of the chosen object treating course.

In addition, when the condition for the object treatment completion time is input, the processor 120 may identify the plurality of object treating courses on the basis of the condition for the object treatment completion time. For example, when a current time is 1:00 p.m. and 1:40 p.m. is input as a washing completion time, the processor 120 may identify a washing course in which a washing time within 40 minutes is required. As an example, the processor 120 may identify the 'quick wash course' in which 15 minutes are required, the 'delicates course' in which 30 minutes are required, and the 'super speed course' in which 39 minutes are required. However, the numerical values for each washing course are mere examples, and are not limited.

When one of the plurality of object treating courses is chosen, the processor 120 may provide information on an object treatment start time to the washing machine 20-1 or the drying machine 20-2 so that the chosen object treating course may be completed at an input object treatment completion time. For example, when 1:40 p.m. is input as a washing completion time and the 'quick wash course' in which 15 minutes are required is chosen, the processor 120 may provide information on a washing operation start time to the object treating device 20 to start a washing operation according to the 'quick wash course' at 1:25 p.m. and complete the washing operation at 1:40 p.m. Alternatively, the processor 120 may provide the information on the washing operation start time to the washing machine 20-1 or the drying machine 20-2. In this case, the washing machine 20-1 or the drying machine 20-2 may determine an object treatment start point in time on the basis of a current time and the washing operation completion time and start object treatment at the determined object treatment start point in time.

When the object treatment completion time is changed and input after the object treatment is started, the processor 120 may provide recommended object treating courses according to a changed time condition. For example, when a completion time different from the previously input completion time is input again during a washing operation according to a specific washing course, the processor 120 may add some washing cycles or exclude some washing cycles on the basis of the again input completion time, and perform washing. Alternatively, the processor 120 may recommend washing courses again on the basis of the again input completion time, and perform washing again from a first washing cycle on the basis of a chosen washing course or perform washing according to a course in which only the remaining washing cycles are chosen when one of the again recommended washing courses is chosen.

In a case where the condition for the object treatment required time and the condition for the object treatment completion time are simultaneously input, the processor 120 may recommend and provide object treating courses that meet these two conditions. For example, when '30 minutes' is input as the washing required time and 2:00 p.m. is input as the washing completion time in a status where a current time is 1:00 p.m., the processor 120 may provide a washing course in which washing may be performed within 30 minutes and be completed at 2:00 p.m. For example, the processor 120 may provide the 'quick wash course' in which 15 minutes are required and the 'delicates course' in which 30 minutes are required.

Therefore, the user may receive the recommended object treating courses corresponding to the condition input by the user himself/herself according to priorities, and may thus receive customized information desired by the user himself/herself.

Meanwhile, when an additional condition for at least one of a kind of object, a color of the object, or a soil of the object is input, the processor 120 may update the list by removing at least some object treating courses from the displayed list or reordering some object treating courses on the basis of such an additional condition. For example, a specific condition may be additionally input after the plurality of object treating courses are displayed on the basis of the condition for the object treatment required time or the object treatment completion time.

For example, in a case where lingerie clothes whose cloth is easily transformed is chosen as a kind of laundry, the processor 120 may change an order of the listed washing courses by removing a washing course in which large frictional force is applied to the laundry or a dewatering speed is relatively fast from the list or giving a low priority to this washing course. In addition, a 'lingerie course' meeting the input condition may be added to the list.

In addition, in a case where a dark color is chosen as a color of the laundry, the processor 120 may change the order of the listed washing courses by removing, for example, a 'boiling course' in which the laundry may be decolorized from the list or giving a low priority to the 'boiling course'.

In addition, in a case where a light soil is chosen as the soil of the laundry, the processor 120 may change the order of the listed washing courses by removing a washing course in which a washing time is long from the list or giving a low priority to this washing course.

When an additional condition for at least one of information related to consumed energy or information related to a damage degree of an object is input, the processor 120 may update the list by removing at least some object treating courses from the list or reordering an order of the plurality of object treating courses on the basis of the additional condition. The processor 120 may provide a UI including an item regarding saving energy consumed to treat the object and an item regarding object damage protecting the object from damage.

For example, in a case where the item regarding saving the consumed energy is chosen, the processor 120 may change the order of the listed washing courses by removing a washing course in which a washing time is long and a washing course in which a relatively large amount of washing water is required due to the large number of times of rinsing from the list or giving a low priority to these washing courses.

In addition, in a case where an item regarding damage to the laundry is chosen, the processor 120 may change the order of the listed washing courses by removing a washing course in which a dewatering speed is relatively fast from the list or giving a low priority to this washing course.

The user has only to input required conditions of the plurality of object treating conditions described above. For example, even though an UI for choosing the kind of laundry is provided after the washing completion time is input, the user may ignore the UI and choose one of the recommended washing courses to input a washing operation start command.

The predetermined criterion described above may be set according to a choice history of the user according to the object treating condition. For example, in a case where the user frequently chooses a washing course in which the washing required time is long among the plurality of recommended washing courses according to the condition for the washing required time or the washing completion time, the predetermined criterion regarding the condition for the washing required time or the washing completion time may be set to an order in which the washing required time is long. In addition, in a case where the user frequently chooses a washing course in which the washing required time is short among the plurality of recommended washing courses due to additional input of a condition for a light soil, the predetermined criterion regarding the condition for the light soil may be set to an order in which the washing required time is short.

The processor 120 may treat the object on the basis of a specific condition. For example, when a condition in which humidity is 70% or more at 5 p.m. is set, the processor 120 may start the washing operation when the set condition is satisfied.

Alternatively, when a wrinkle preventing function turn-on condition is set if the washing operation or the drying operation is completed when the user goes out, the processor 120 may turn on the wrinkle preventing function when the set condition is satisfied. According to an embodiment, in a case where the user terminal device 100 is spaced apart from the object treating device 20 by a predetermined distance or more, the processor 120 may identify that the user goes out to turn the wrinkle preventing function. Therefore, the processor 120 may prevent a wrinkle of the laundry by rotating a washing tub or a drying tub to prevent the wrinkle of the laundry at the time of the completion of the washing operation or the drying operation.

When the object treatment according to the chosen object treating course is started, the processor 120 may provide animation images representing object treatment statuses on the basis of information on the object treatment statuses for each object treating cycle. Here, the object treating cycle may be at least one of a washing cycle or a drying cycle. The washing cycle may include a weight sensing cycle of the laundry, a washing cycle for washing the laundry with water in which a detergent is dissolved, a rinsing cycle for rinsing the laundry with clear water, and a dewatering cycle for removing water from the laundry, and the drying cycle may include a drying cycle for drying an object to be dried on the basis of temperature and a blowing cycle for drying the object to be dried on the basis of wind.

For example, the processor 120 may provide an animation image in which a visualized circular image of a washing tub rotates during a period in which the weight sensing cycle progresses, provide an animation image in which washing water and a detergent are provided to and the washing water is filled up in the image of the washing tub during a period in which the washing cycle progresses, an animation image in which washing water is provided to the image of the washing tub during a period in which the rinsing cycle progresses, an animation image in which water drops splash out of the image of the washing tub during a period in which the dehydration cycle progresses, and an animation image in which a T-shirt image flickers when the entire washing cycle is completed. The processor 120 may provide different animation images according to the chosen washing course even in the same washing cycle. For example, the processor 120 may provide an animation image representing a relatively large amount of washing water in the washing cycle or the dewatering cycle in a case of a washing course in which an amount of washing water is large, and provide an animation image representing a relatively fast rotation speed of the washing tub in the dewatering cycle in a case of a washing course in which a dewatering speed is fast.

In addition, the processor 120 may provide an animation image representing drying by temperature by displaying a visualized circular image of a drying tub in red or in a flame shape during a period in which the drying cycle progresses, and provide an animation image representing drying by wind by displaying the image of the drying tub in blue or in a wind shape during a period in which the blowing cycle progresses.

However, the animation images are not limited thereto, and may represent the respective cycles by various methods.

The processor 120 may provide an animation image that includes a progress bar guiding the remaining object treatment required time on the basis of the object treatment required time of the object treating course and an object treating progress time at a current point in time and color information (guiding the remaining object treatment required time on the basis of the object treatment required time of the object treating course and an object treating progress time at a current point in time). The progress bar may have, for example, a shape of a circular bar surrounding the image of the washing tub, and an entire region of the progress bar represents a total object treatment required time. As an object treating cycle progresses, the progress bar may be displayed in a dark color from a starting point of the progress bar to a point at which the object treating currently progresses. Therefore, a region of the progress bar that is not displayed in the dark color may represent the remaining object treating process. Therefore, the user may intuitively confirm a progress situation of the object treating cycle only by a progress status of the progress bar. However, the progress bar is not limited to having the circular shape, and may be implemented in various shapes.

The processor 120 may change a color of the image of the washing tub or the drying tub according to the progress situation of the object treating cycle by designating a predetermined color for each cycle. Therefore, the user may intuitively confirm the progress situation of the object treating cycle.

The processor 120 may provide a UI including items representing kinds of different objects. The different objects may be classified according to a predetermined criterion item. Here, the predetermine criterion item may be classified into an ordinary, an underwear, a sportswear, a sleeping gear, and the like, but is not limited thereto. The item representing the kind of object may display only a name of the kind of object or display an image corresponding to the kind of object together with the name of the kind of object. For example, in an item representing a T-shirt, only a 'T-shirt' may be described or a T-shirt image may be provided together with the 'T-shirt'.

Subsequently, when an item representing a kind of specific object is chosen on the UI, the processor 120 may provide a guide for adding a kind of object on the basis of the kind of specific object. For example, when the item representing the T-shirt is chosen, items representing kinds of laundry inappropriate to be washed together with the T-shirt may be inactivated, and a guide for washing of the T-shirt may be provided as a text. Here, the inactivation means that items inappropriate to be washed or dried together with the chosen item may be dimmed or be removed from the UI.

Meanwhile, the kind of object may be chosen by touching the item representing the kind of object or be chosen by dragging and dropping the item representing the kind of object into a predetermined region in a status of touching the item. In a case where the dimmed item is touched, the dimmed item may not be chosen. In addition, in a case where the dimmed item is touched to be dragged and dropped into the predetermined region, the dimmed item is not put in the predetermined region, but is bounced, such that the item may not be chosen.

The processor 120 may display the total object treatment required time and the remaining object treatment required time.

According to an embodiment, when at least one of the condition for the object treatment required time or the condition for the object treatment completion time is input, the processor 120 may identify the plurality of object treating courses that meet the condition, and provide a summed time of the washing operation and the drying operation according to each object course on the display 110.

For example, in a case where a current time is 6:10 p.m. and 10 p.m. is input as a completion time of the washing operation and the drying operation, the processor 120 may identify each course capable of performing the washing operation and the drying operation for three hours and 50 minutes, and provide the summed time of the washing operation and the drying operation according to the identified course on the display 110. As an example, when a standard washing course and a standard drying course are identified, the processor 120 may provide time information indicating that an operation time of the standard washing course is two hours and an operation time of the standard drying course is one hour and a half on the display 110, and provide summed time information indicating that a summed time of the standard washing course and the standard drying course is three hours and 30 minutes on the display 110.

Therefore, the user may recognize a total object treatment required time including a drying operation time as well as a washing operation time.

The processor 120 may choose the same kind of object to be dried as that of laundry chosen at the time of the washing operation. The processor 120 may provide a UI in a status where the same kind of object to be dried as that of laundry is chosen on a UI for receiving a choice for the object to be dried. For example, in a case where a T-shirt and blue jeans are chosen at the time of the washing operation, the processor 120 may provide a UI for a drying operation in a status where the T-shirt and the blue jeans are chosen to the user. In general, after the washing operation, the laundry included in the washing machine is transferred to and dried in the drying machine, and the laundry and the object to be dried may thus be the same as each other. Also in an object treating device including both of a washing function and a drying function, generally, the laundry and the object to be dried may be the same as each other. Therefore, in an embodiment of the disclosure, inconvenience that the kind of object to be dried is chosen once again may be reduced. However, an object to be dried different from the laundry may be chosen by a choice of the user.

When one of the plurality of object treating courses regarding the washing operation is chosen, the processor 120 may identify object treating courses regarding the drying operation on the basis of the chosen object treating course. The processor 120 may provide a list in which information on the identified object treating courses regarding the drying operation is listed, on the display 110.

Specifically, the processor 120 may provide a list in which information on drying courses similar to the chosen washing course is listed, on the display 110.

For example, in a case where the standard washing course of a plurality of washing courses provided according to the input condition is chosen, the processor 120 may recommend the standard drying course similar to the standard washing course, and provide text information describing a drying operation required time and the standard drying course, which is information on the standard drying course, on the display 110.

Meanwhile, the various UIs described above may be provided through a screen of an application installed in the electronic device 100. In this case, the application may store identification information (a serial number, a model, or the like) on an external object treating device 20 (FIG. 1) and information on functions corresponding to the identification information, and may provide the various UIs described above on the basis of these information.

FIG. 2B is a block diagram illustrating an example of detailed components of the electronic device of FIG. 2A.

According to FIG. 2B, the electronic device 100 includes the display 110, the processor 120, a communicator 130, a storage 140, and an audio output 150. A detailed description for components overlapping the components illustrated in FIG. 2A among components illustrated in FIG. 2B will be omitted.

The processor 120 may execute an operating system (OS), programs, and various applications stored in the storage 140 when a predetermined event occurs. The processor 120 may include a single core, a dual core, a triple core, a quad core, or a multiple-number core thereof For example, a CPU 121 included in the processor 120 accesses the storage 140 to perform booting using the OS stored in the storage 140. In addition, the CPU 121 performs various operations using various programs, contents, data, and the like, stored in the storage 140.

The communicator 130 performs communication with the object treating device 20. Here, the communicator 130 may perform wireless communication with the object treating device 20 in a communication manner such as Bluetooth (BT), wireless fidelity (Wi-Fi), Zigbee, or infrared (IR), or may perform wireless communication with the object treating device 20 in various communication manners such as a serial interface, a universal serial bus (USB), a near field communication (NFC), and the like.

For example, when the predetermined event occurs, the communicator 130 may become a link status with the object treating device 20 by performing communication according to a predefined communication manner with the object treating device 20. Here, the link status may mean all statuses in which communication is possible, such as an operation in which communication between the electronic device 100 and the object treating device 20 is initialized, an operation in which a network is formed, an operation in which device pairing is performed, and the like. For example, device identification information of the object treating device 20 is provided to the electronic device 100, such that a pairing procedure between the object treating device 20 and the electronic device 100 may be performed. For example, when a predetermined event occurs in the electronic device 100 or the object treating device 20, the electronic device 100 or the object treating device 20 may search for a peripheral device through a digital living network alliance (DLNA) technology, and perform pairing with the searched device to become a link status with the searched device.

The storage 140 may store various data, programs, or applications for driving and controlling the electronic device 100. The storage unit 140 may store control programs for controlling the electronic device 100 and the processor 120, and applications, databases, and related data initially provided from a manufacturer or downloaded from the outside. For example, the storage 140 may store an application for providing UIs according to various embodiments of the disclosure.

Here, the storage 140 may be implemented by an internal memory such as a read only memory (ROM), a random access memory (RAM), or the like, included in the processor 120 or be implemented by a memory separate from the processor 120. In this case, the storage 140 may be implemented in a form of a memory embedded in the electronic device 100 or a form of a memory attachable to and detachable from the electronic device 100, depending on a data storing purpose. For example, data for driving the electronic device 100 may be stored in the memory embedded in the electronic device 100, and data for an extension function of the electronic device 100 may be stored in the memory attachable to and detachable from the electronic device 100. Meanwhile, the memory embedded in the electronic device 100 may be implemented in a form of a nonvolatile memory, a volatile memory, a hard disk drive (HDD), a solid state drive (SSD), or the like.

The audio output 150 functions to output an audio signal. For example, the audio output 150 may include at least one speaker unit (or an audio amplifier) capable of outputting the audio signal.

According to an embodiment, when the electronic device 100 is connected to the external object treating device 20, the processor 120 may receive the identification information (the serial number, the model, or the like) on the external object treating device 20, and receive and store information on various functions corresponding to the identification information and a UI screen from an external server or the like. For example, when the electronic device 100 is connected to the external object treating device 20 in a status where an application for providing a UI screen according to an embodiment of the disclosure is driven, the processor 120 may receive the identification information (the serial number, the model, or the like) on the object treating device 20 from the object treating device 20, receive various information corresponding to the identification information, and store the received information in the application.

Figure 3A:
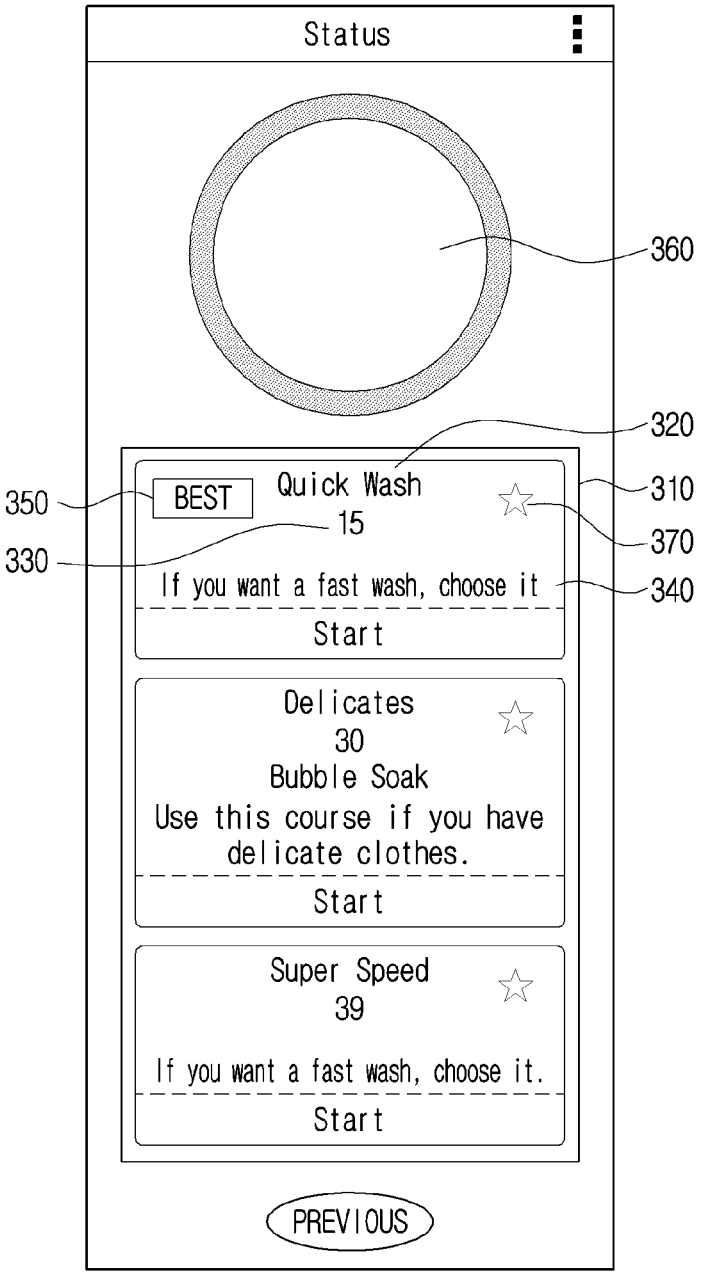
FIGS. 3A and 3B are views illustrating lists in which information on a plurality of object treating courses is listed according to an embodiment of the disclosure.
Figure 3B:
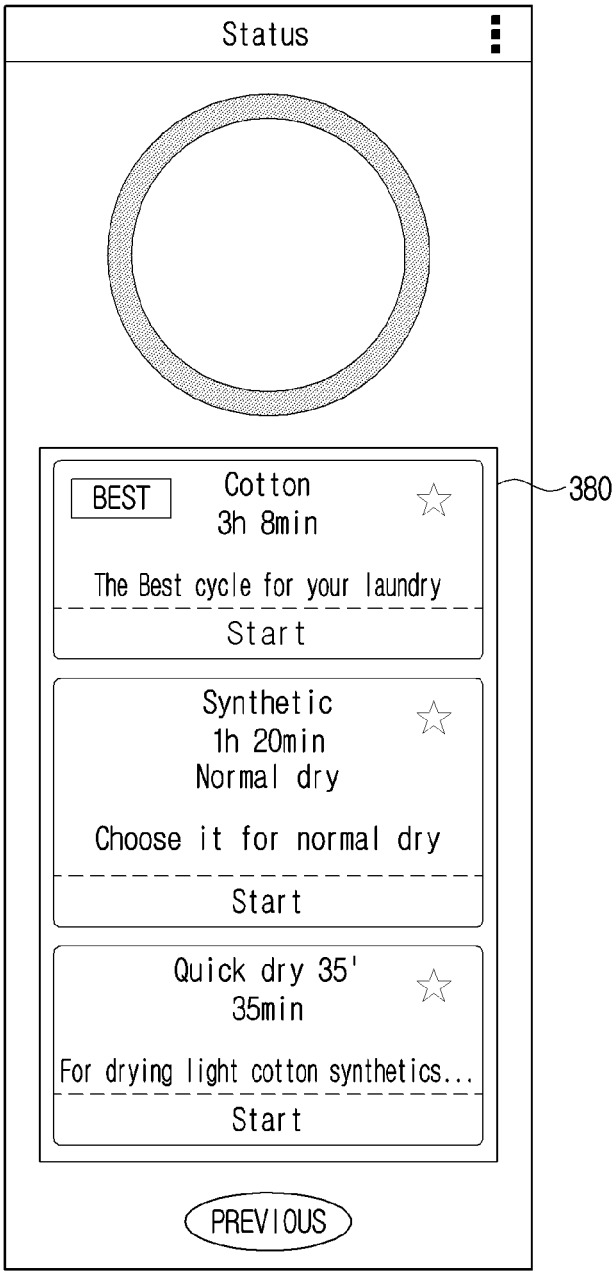

FIGS. 3A and 3B are views illustrating lists in which information on a plurality of object treating courses is listed according to an embodiment of the disclosure.

According to FIG. 3A, the electronic device 100 may recommend washing courses by providing a list 310 in which information on a plurality of washing courses is listed on the basis of an input washing condition. The information on the washing course may include a name 320 of the washing course, a washing required time 330, a guide 340 describing the washing course, and an icon 350 representing a washing course having the highest priority on the basis of the input washing condition. For example, 'BEST' may be described in the icon 350 representing the washing course having the highest priority. Information on the input washing condition may be provided in a predetermined region 360. For example, when one hour and a half is chosen as a condition for the washing required time, a text 'within one hour and a half' may be provided in the predetermined region 360.

However, the disclosure is not limited thereto, and information on temperature of washing water, the number of rinsing cycles, or the washing completion time may be included in each list.

The electronic device 100 may identify priorities of the plurality of washing courses according to the predetermined criterion, and provide the list in which the information on the plurality of washing courses is listed on the basis of the identified priorities. For example, the list may be provided in an order in which the washing required time is short. However, the predetermined criterion is not limited thereto, and may be an order in which the washing required time is long, an order in which a washing effect is good, or an order in which damage to the laundry is low.

The electronic device 100 may designate each washing course as a favorite item by a choice of the user. For example, an icon 370 representing a favorite may be chosen to register the corresponding washing course as a favorite item, and in a case of a washing course already registered, a corresponding icon 370 may be chosen again to be removed from the favorite item. In the washing course registered as the favorite item, a washing operation may be rapidly started by executing the washing course registered as the favorite item through a separate menu without inputting conditions such as a washing completion time, a washing required time, and information of laundry, and the like.

According to FIG. 3B, the electronic device 100 may recommend washing courses by providing a list 380 in which information on a plurality of drying courses is listed on the basis of an input drying condition. The information on the drying course may include a name of the drying course, a drying required time, a guide describing the drying course, and an icon representing a drying course having the highest priority on the basis of the input drying condition. For example, 'BEST' may be described in the icon 350 representing the drying course having the highest priority.

FIGS. 4A to 4D are views illustrating screens for setting a condition for a completion time according to an embodiment of the disclosure.

The setting for the condition for the completion time is a setting applied to at least one of the washing operation or the drying operation, and FIGS. 4A and 4B will be described on the basis of the washing operation for convenience.

Figure 4A:
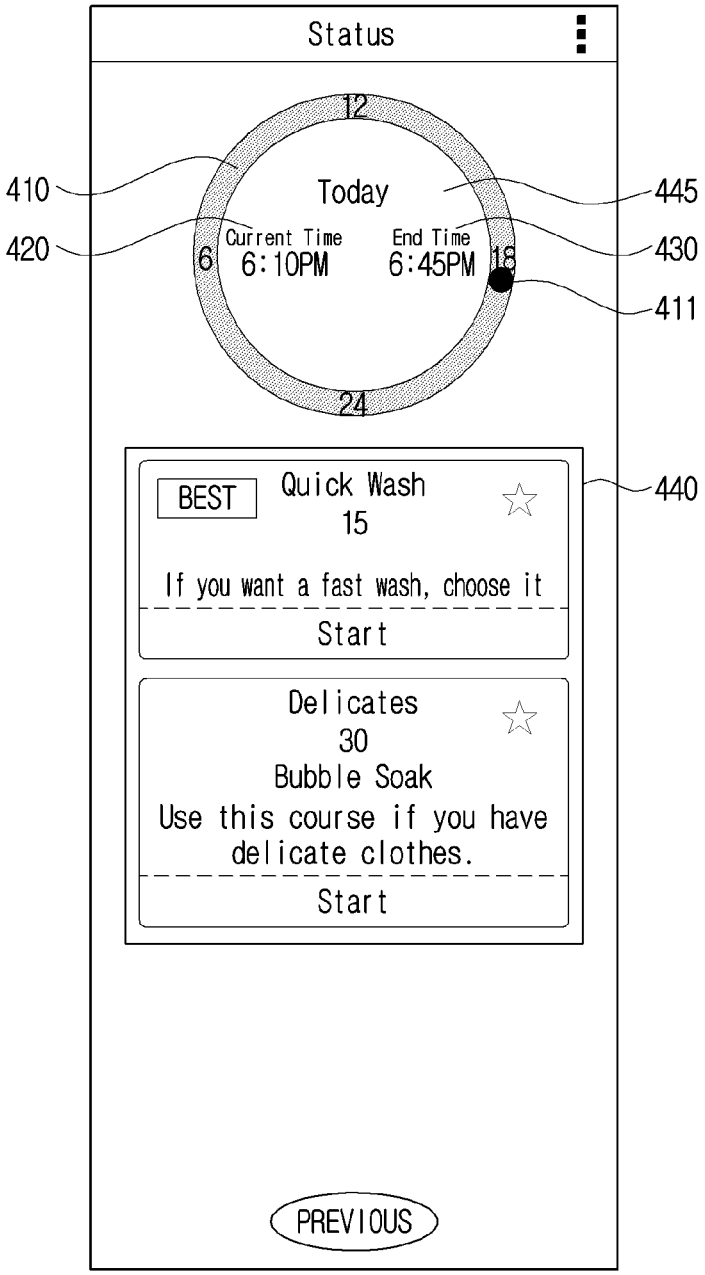
FIGS. 4A to 4D are views illustrating screens for setting a condition for a completion time according to an embodiment of the disclosure.

According to FIG. 4A, the electronic device 100 may display a progress bar 410 having a circular shape, a current time 420, and a washing completion time 430. Here, one turn of the progress bar 410 may indicate 24 hours. The electronic device 100 may display a point 411 corresponding to the current time on the progress bar 410. This point is dragged by a touch of the user and is dropped to a desired washing completion time, such that the washing completion time may be set. In addition, when a region of the washing completion time 430 is chosen, the electronic device 100 may provide a UI including a numeric keyboard so that the user may directly input a time. The electronic device 100 may recommend washing courses by displaying a list 440 in which information on the washing courses is listed on the basis of the condition for the completion time.

For example, when the current time is 6:10 p.m. and 6:45 p.m. is input as the washing completion time, a washing course in which a washing time within 35 minutes is required may be displayed. As an example, the 'quick wash course' in which 15 minutes are required and the 'delicates course' in which 30 minutes are required may be displayed. Subsequently, when the 'quick wash course' in which 15 minutes are required is chosen, a washing operation according to the 'quick wash course' may be started at 6:30 p.m., and be completed at 6:45 p.m. However, the numerical values for each washing course are mere examples, and are not limited.

The electronic device 100 may change a background color of a predetermined region 445 on the basis of the current time. For example, a background may be displayed in a bright color from 6 a.m. to 12 p.m., may be displayed in a relatively brighter color from 6 a.m. to 12 p.m., may be displayed in a dark color from 6 p.m. to 12 a.m., and may be displayed in a relatively darker color from 12 a.m. to 6 a.m., in the predetermined region 445. Alternatively, different icons representing the morning and afternoon may be displayed on the basis of the current time.

Figure 4B:
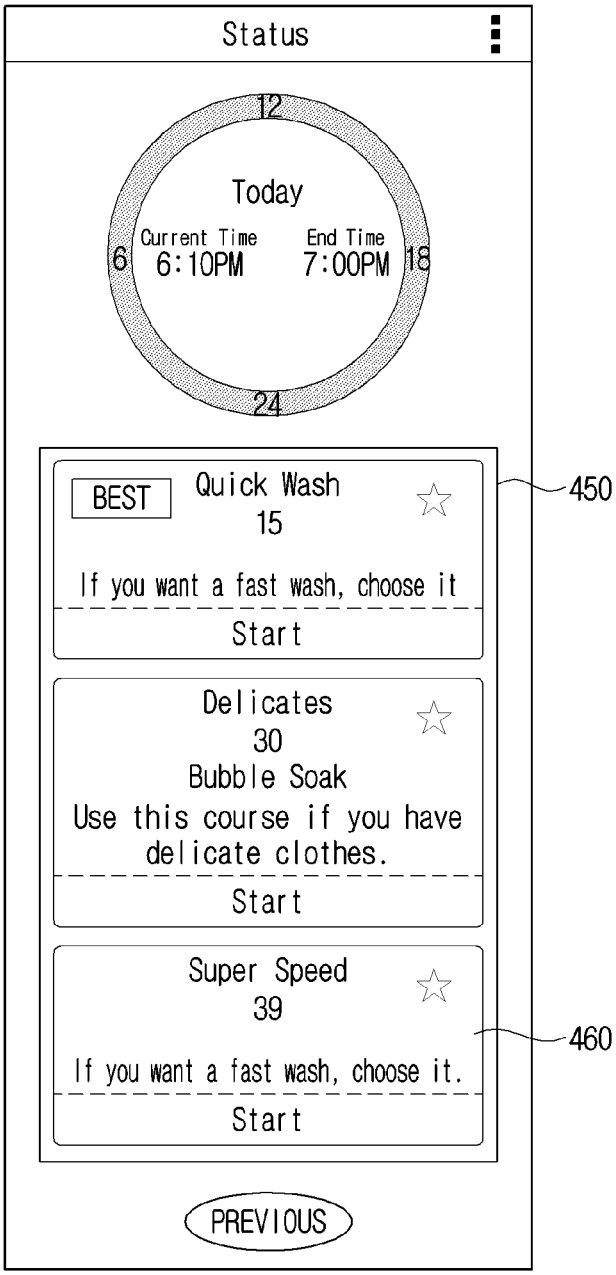

According to FIG. 4B, when the washing completion time is changed, the electronic device 100 may display a list 450 updated on the basis of the changed washing completion time. In a case where the washing completion time is changed into a time later than the input time, a time required for washing the laundry is increased, and the list 450 including more washing courses may thus be displayed. In addition, in a case where the washing completion time is changed into a time earlier than the input time, a time required for washing the laundry is decreased, and the list 450 including fewer washing courses may thus be displayed.

For example, in a case where the washing completion time is changed from 6:45 p.m. to 7:00 p.m., it will take 50 minutes for wash the laundry from 6:10 p.m., which is the current time, and the updated list 450 including a 'super speed' washing course 460 in which 39 minutes are required may thus be displayed.

Figure 4C:
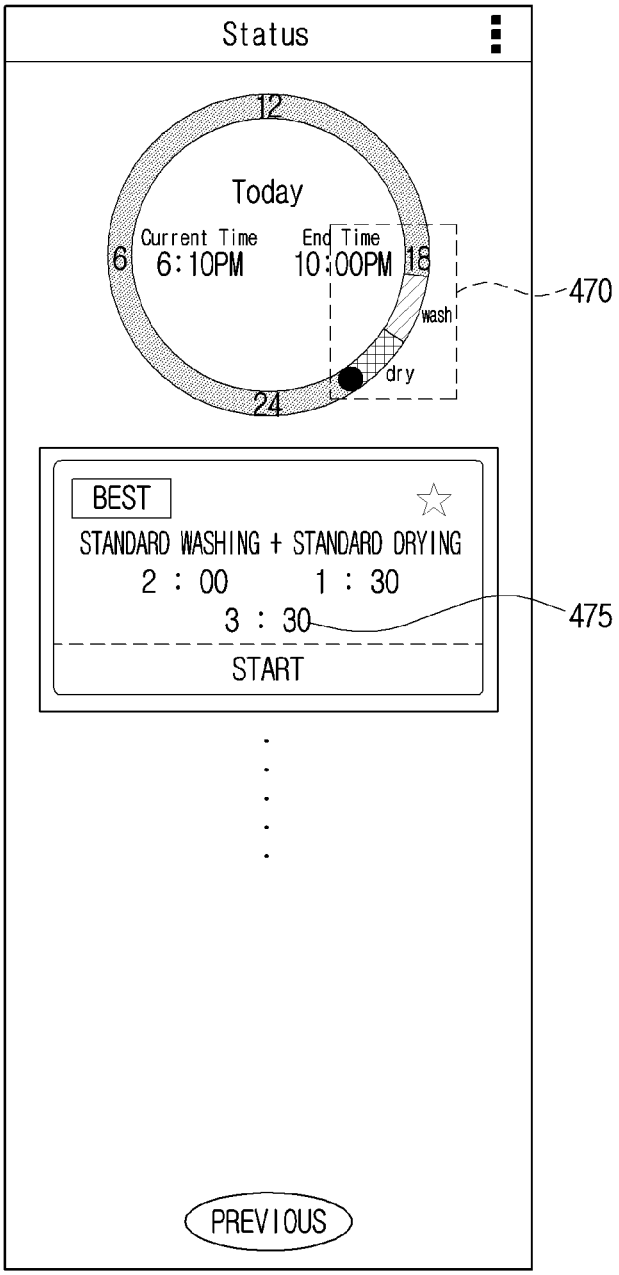

FIG. 4C is a view for describing an operation in which a washing operation and a drying operation are set together.

According to FIG. 4C, as illustrated in FIG. 4A, the electronic device 100 may display a point corresponding to a current time on the progress bar. This point is dragged by a touch of the user and is dropped to a desired object treatment completion time, such that a completion time of the washing operation and the drying operation may be set. In addition, when a region of the object treatment completion time is chosen, the electronic device 100 may provide a UI including a numeric keyboard so that the user may directly input a time. The electronic device 100 may recommend washing courses and drying courses by displaying a list in which information on the washing courses is listed on the basis of the condition for the completion time. The electronic device 100 may represent information on a washing time and a drying time of courses having the highest priority among the recommended courses in the progress bar.

For example, in a case where a current time is 6:10 p.m. and 10 p.m. is input as a completion time of the washing operation and the drying operation, the electronic device 100 may identify each course capable of performing the washing operation and the drying operation for three hours and 50 minutes, and provide a summed time of the washing operation and the drying operation according to the identified course. As an example, when a standard washing course and a standard drying course are identified, the electronic device 100 may provide time information indicating that an operation time of the standard washing course is two hours and an operation time of the standard drying course is one hour and a half, and provide summed time information 475 indicating that a summed time of the standard washing course and the standard drying course is three hours and 30 minutes.

Therefore, the user may recognize a total object treatment required time including a drying operation time as well as a washing operation time.

Figure 4D:
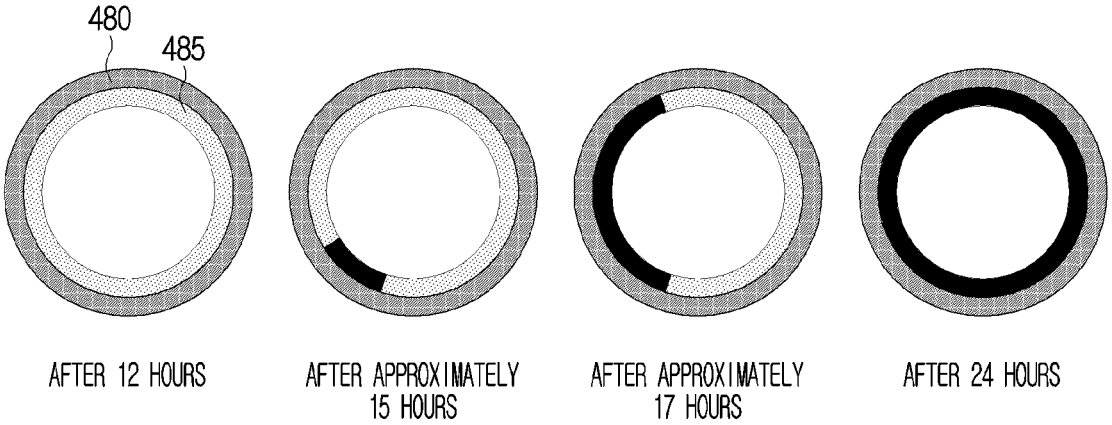

FIG. 4D illustrates a progress bar whose one turn is 12 hours.

According to FIG. 4D, a basic progress bar 480 may represent only 12 hours. In this case, when 12 hours are exceeded on the basis of a current time, a new progress bar 485 may be added inside the basic progress bar 480 to represent a time from the current time to 24 hours after the current time. For example, a dark region gradually increases in the added progress bar 485 as 15 hours and 17 hours elapse from the current time, and an entire region of the added progress bar 485 may be displayed in a dark color after 24 hours.

These two progress bars have a time interval wider than that of a progress bar representing 24 hours at a time. Therefore, in a case where an icon representing a washing completion point in time is dragged by a touch of the user and is dropped to a desired washing completion time, such that the washing completion time is set, the user may relatively accurately choose the washing completion time. However, the disclosure is not limited thereto, and the added progress bar may be added outside the basic progress bar 480, and one or more progress bars may be added to represent a time from the current time to 24 hours after the current time.

Figure 5:
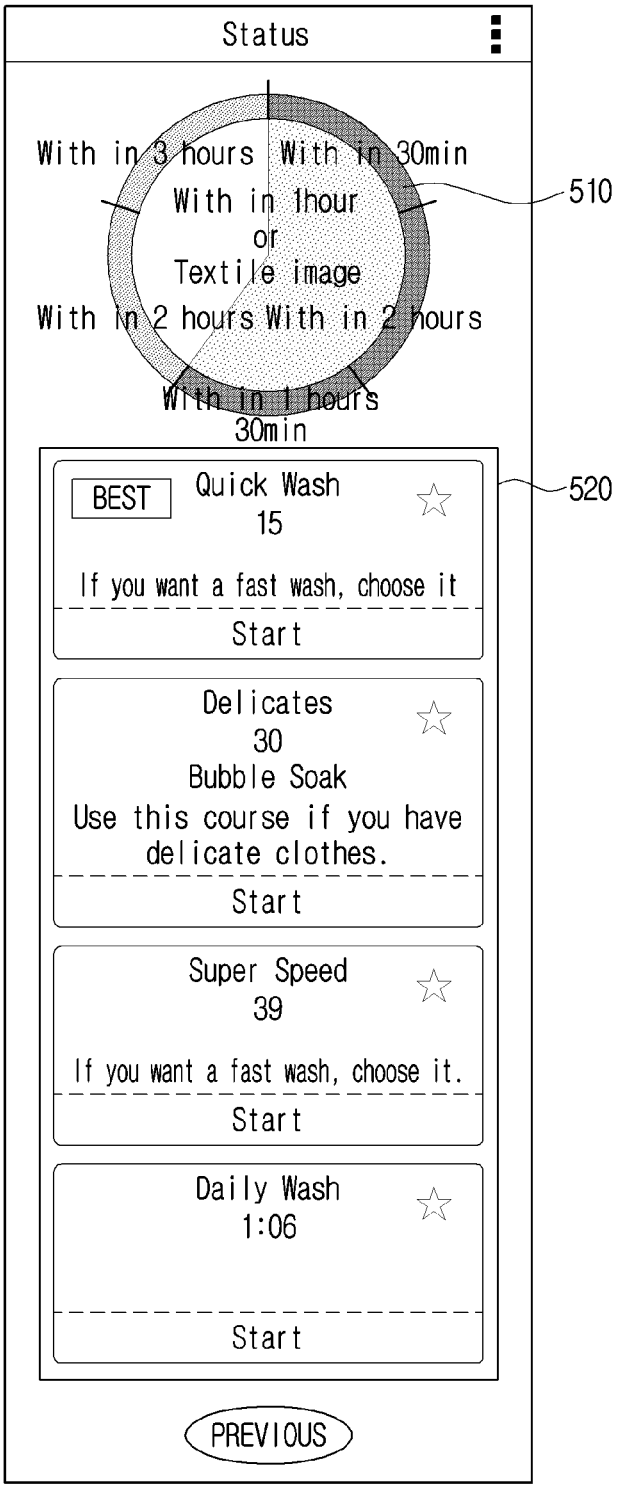
FIG. 5 is a view illustrating a screen for setting a condition for a washing required time according to an embodiment of the disclosure.

FIG. 5 is a view illustrating a screen for setting a condition for a washing required time according to an embodiment of the disclosure.

According to FIG. 5, the electronic device 100 may set a maximum time that may be required for washing the laundry, and divide the maximum time according to specific time intervals, and display the divided times as a circular image 510. For example, the electronic device 100 may set the maximum time that may be required for washing the laundry to 3 hours, divide the maximum time into sections such as 30 minutes, one hour, one hour and a half, two hours, and three hours, and display the sections. In a case where a specific section is chosen, a section requiring a washing required time longer than the chosen section may be dimmed. However, the disclosure is not limited thereto, and the maximum time that may be required for washing the laundry and an interval of each section may be variously modified.

The electronic device 100 may recommend washing courses by displaying a list 520 in which information on washing courses in which washing may be performed in a chosen washing required time is listed.

For example, when 'one hour and a half' is input as the washing required time, a washing course in which a washing time within one hour and a half is required may be displayed. As an example, the 'quick wash course' in which 15 minutes are required, the 'delicates course' in which 30 minutes are required, the 'super speed course' in which 39 minutes are required, and the 'daily wash course in which one hour and six minutes are required may be displayed. Subsequently, when one washing course is chosen, a washing operation may be started according to the chosen washing course. However, the numerical values for each washing course are mere examples, and are not limited.

FIG. 5 describes an operation of setting the condition for the washing required time for convenience, and an operation of setting a condition for a drying required time is also the same as that of the description of FIG. 5. In addition, a condition for a summed required time of washing and drying required times may be set. For example, in a case where the summed required time of the washing and drying required times is set to 3 hours, the electronic device 100 may recommend courses in which a summed time of washing and drying courses is within 3 hours.

FIGS. 6A to 6D are views illustrating screens for setting a condition for kinds of objects according to an embodiment of the disclosure.

Figure 6A:
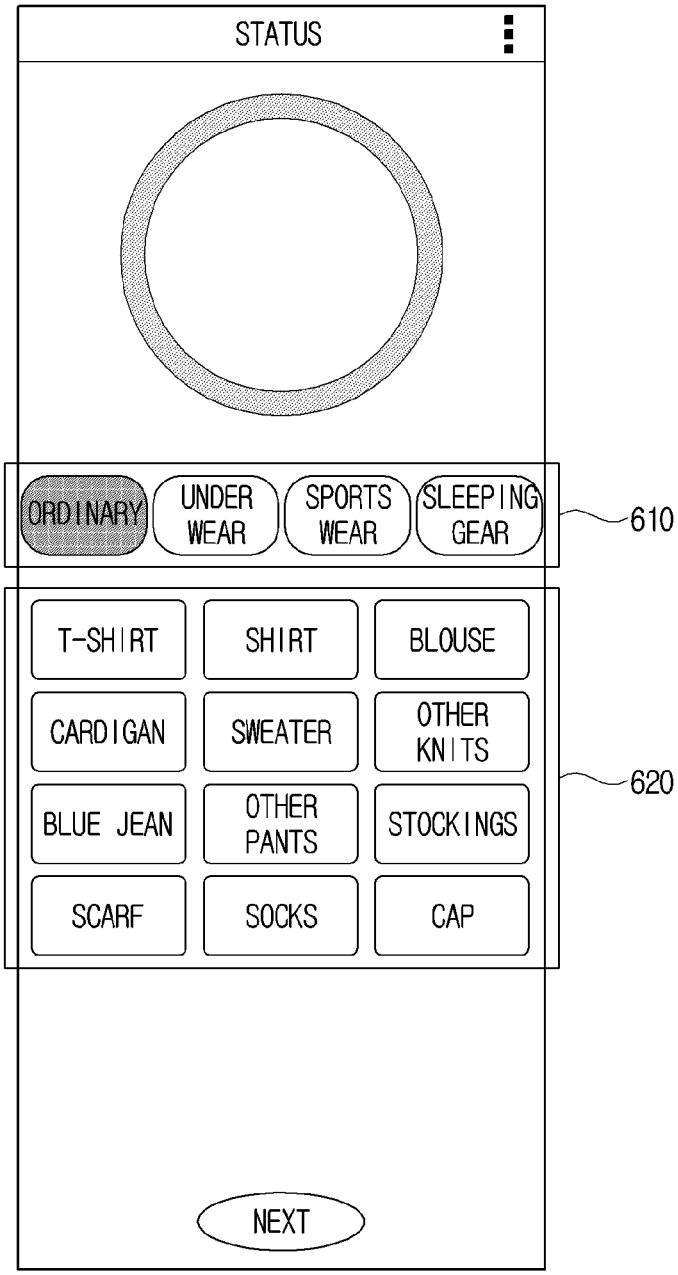

According to FIG. 6A, the electronic device 100 may display a UI 620 including items representing kinds of different objects according to a predetermined criterion item 610. The predetermine criterion item may be classified into an ordinary, an underwear, a sportswear, a sleeping gear, and the like, but is not limited thereto. The item representing the kind of object may display only a name of the kind of object or display an image corresponding to the kind of object together with the name of the kind of object. For example, in an item representing a T-shirt, only a 'T-shirt' may be described or a T-shirt image may be provided together with the 'T-shirt'. In general, the ordinary, the underwear, the sportswear, and the sleeping gear are arranged in the order in which the items are frequently chosen by the user, such that accessibility of the items may be improved. However, an arrangement order of the items may be changed on the basis of an item choice history of the user.

Figure 6B:
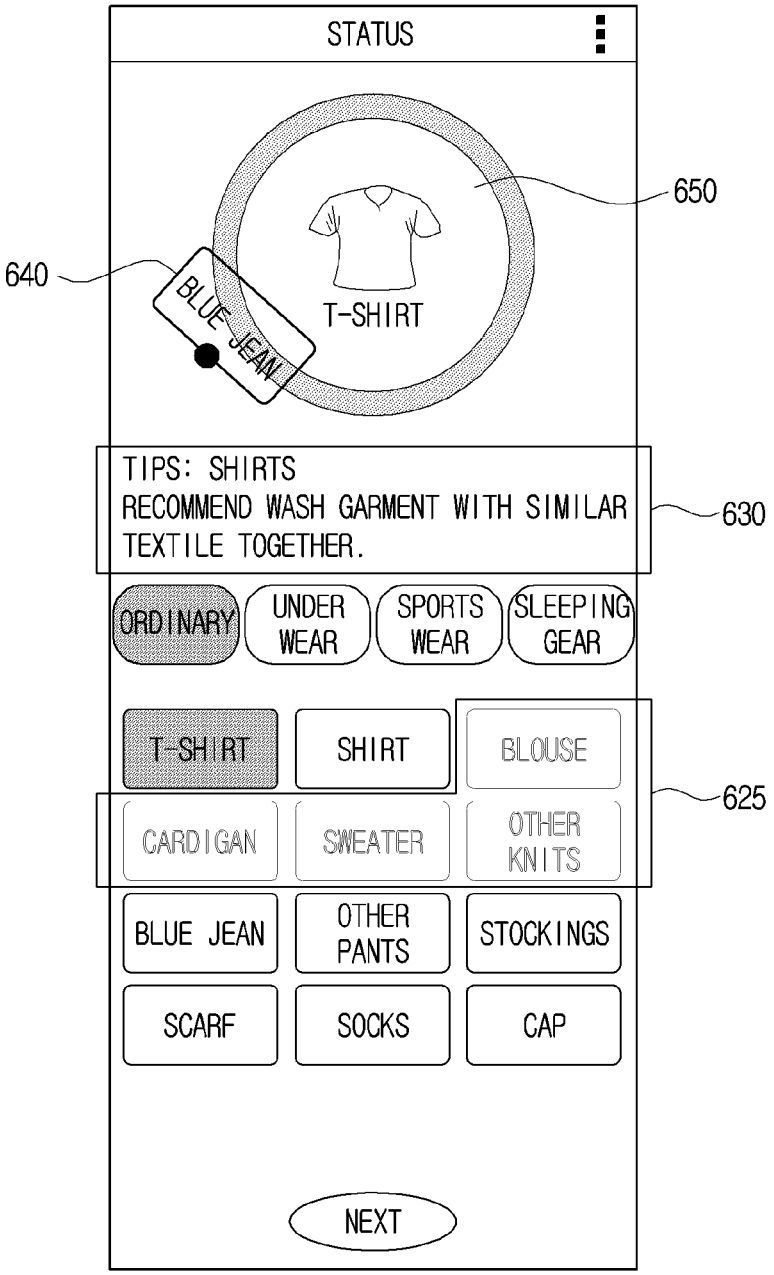

According to FIG. 6B, when an item representing a kind of specific object is chosen, the electronic device 100 may provide a guide for adding a kind of object on the basis of the kind of specific object. For example, when the item representing the T-shirt is chosen, items representing kinds of laundry inappropriate to be washed together with the T-shirt may be inactivated (625), and a guide for washing of the T-shirt may be provided as a text 630 in a predetermined region of the display 110. Items representing kinds of objects may also be inactivated on the basis of an input object treatment required time. For example, items representing kinds of objects that may not be treated within the input object treatment required time may be inactivated. Here, the inactivation means that items inappropriate to be treated together with the chosen item may be dimmed or be removed from the UI.

Meanwhile, the kind of object may be chosen by touching the item representing the kind of object or be chosen by dragging and dropping (640) the item representing the kind of object into a predetermined region 650 in a status of touching the item. In a case where the dimmed item is touched, the dimmed item may not be chosen. In addition, in a case where the dimmed item is touched to be dragged and dropped into the predetermined region, the dimmed item is not put in the predetermined region, but is bounced, such that the item may not be chosen.

When the kind of object is chosen and a command indicating that an input for an object treatment condition by the user has been completed is input, the electronic device 100 may update a displayed list by removing at least some object treating courses from the displayed list or reordering some object treating courses on the basis of the chosen kind of object.

For example, in a case where lingerie clothes whose cloth is easily transformed is chosen as the kind of object, the order of the listed object treating courses may be changed by removing an object treating course in which large frictional force is applied to the object or a dewatering speed is relatively fast from the list or giving a low priority to this object treating course. In addition, a 'lingerie course' meeting the input condition may be added to the list.

Figure 6C:
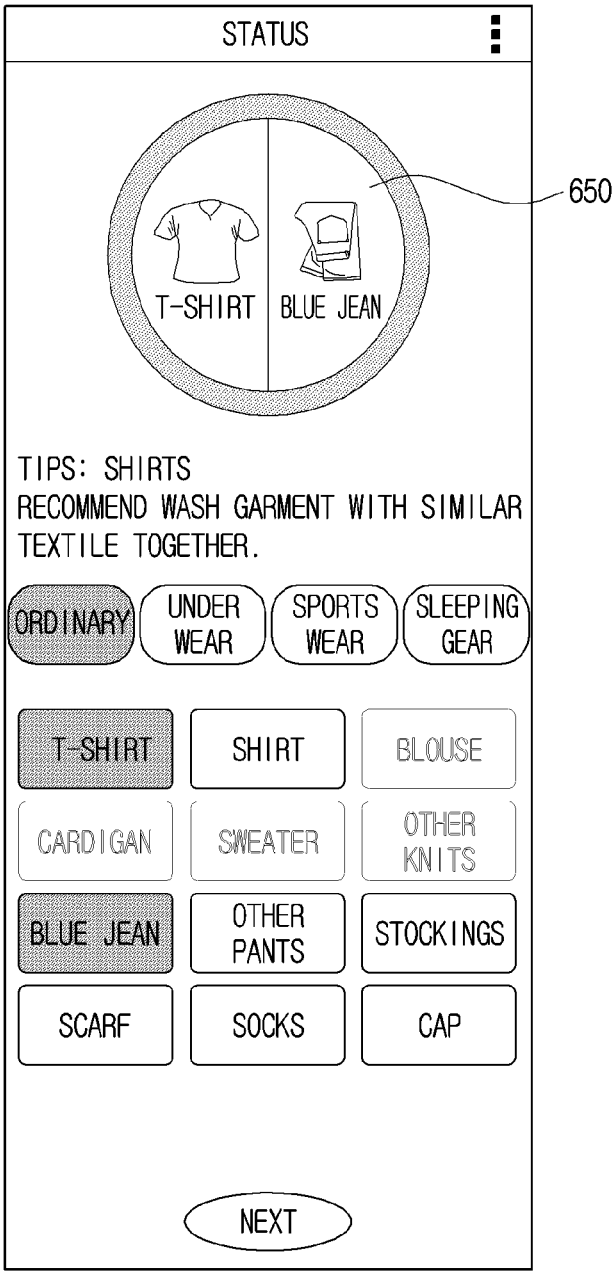

According to FIG. 6C, in a case where the kind of object is chosen, the electronic device 100 may display an image corresponding to the chosen kind of object in the predetermined region 650 to cause the user to intuitively grasp the chosen kind of object. In a case where the number of the chosen kinds of objects is plural, the electronic device 100 may divide the predetermined region 650 and display a plurality of images corresponding to the chosen kinds of objects.

FIG. 6D is a table illustrating kinds of different objects according to predetermined criterion items. An ordinary item 660 may include a T-shirt, a shirt, a blouse, a cardigan, a sweater, other knits, a blue jean, other pants, stockings, a scarf, socks, a hat, and the like, an underwear item 670 may include a lingerie, a brassiere, panties, and the like, a sportswear item 680 may include a gym suit, a mountain sportswear, a swimming suit, a skiwear, and the like, and a sleeping gear item 690 may include a towel, a duvet cover, a bed sheet, a curtain, and the like. In a case where objects in the ordinary item 660 are provided in the UI 620 representing the kinds of objects, the objects may be provided in the order of top, bottom, and others. However, the order in which the objects are provided is not limited thereto.

However, the criterion items and the kinds of objects included in the criterion items are not limited thereto, and may be modified into various forms.

Figure 7:
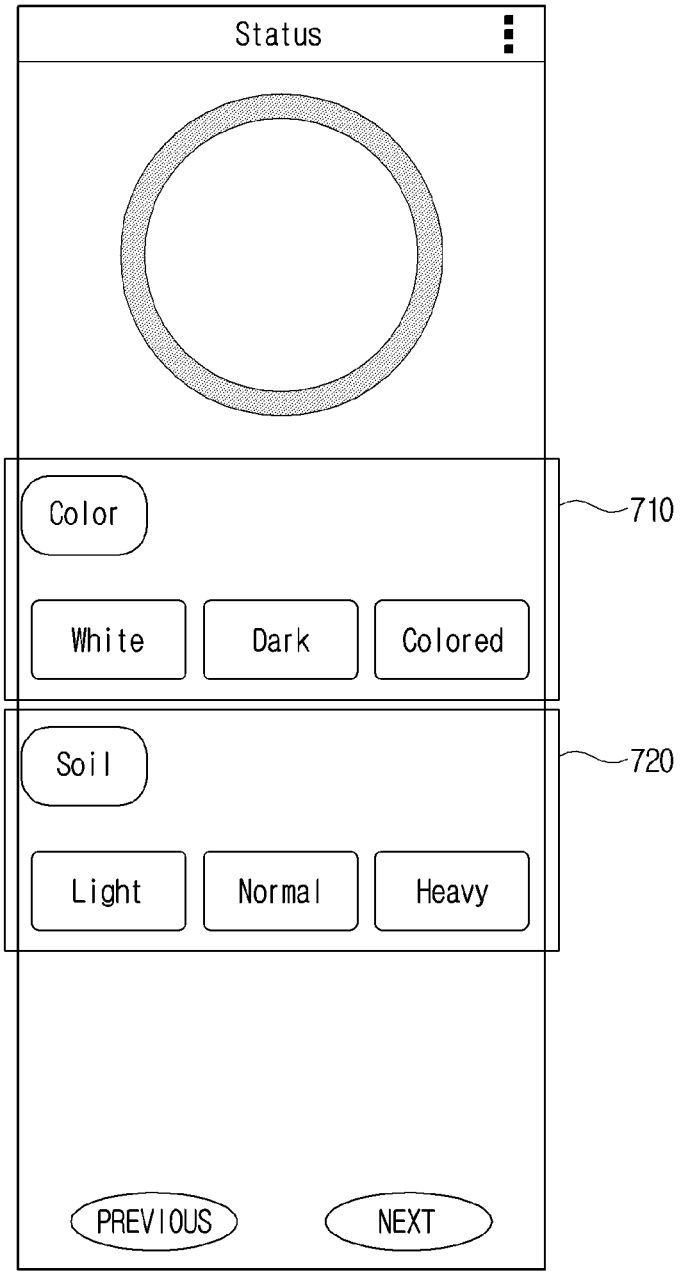
FIG. 7 is a view illustrating a screen for setting a condition for a color and a soil of an object according to an embodiment of the disclosure.

FIG. 7 is a view illustrating a screen for setting a condition for a color and a soil of an object according to an embodiment of the disclosure.

According to FIG. 7, the electronic device 100 may display UIs representing a color of the object and the soil of the object. The UI 710 representing the color may include 'White' representing an object having a white color, 'Dark' representing an object having a dark color, and 'colored' representing objects having colors other than the white color and the dark color. In addition, the UI 720 representing the soil of the object may include 'Light' representing a light soil, 'Normal' representing a normal soil, and 'Heavy' representing a heavy soil. However, the color and the soil are not limited thereto, and may be further subdivided. Even though the color and the soil are not chosen by the user, the electronic device 100 may set a color 'colored' and a soil 'normal' as basic values.

When the color and the soil of the object are chosen and a command indicating that an input for an object treatment condition by the user has been completed is input, the electronic device 100 may update a displayed list by removing at least some object treating courses from the displayed list or reordering some object treating courses on the basis of the color and the soil of the object.

For example, in a case where the dark color is chosen as the color of the object, the order of the listed object treating courses may be changed by removing, for example, a 'boiling course' in which the object may be decolorized from the list or giving a low priority to the 'boiling course'.

In a case where the light soil is chosen as the soil of the object, the order of the listed washing courses may be changed by removing a washing course in which a washing time is long from the list or giving a low priority to this washing course.

Figure 8:
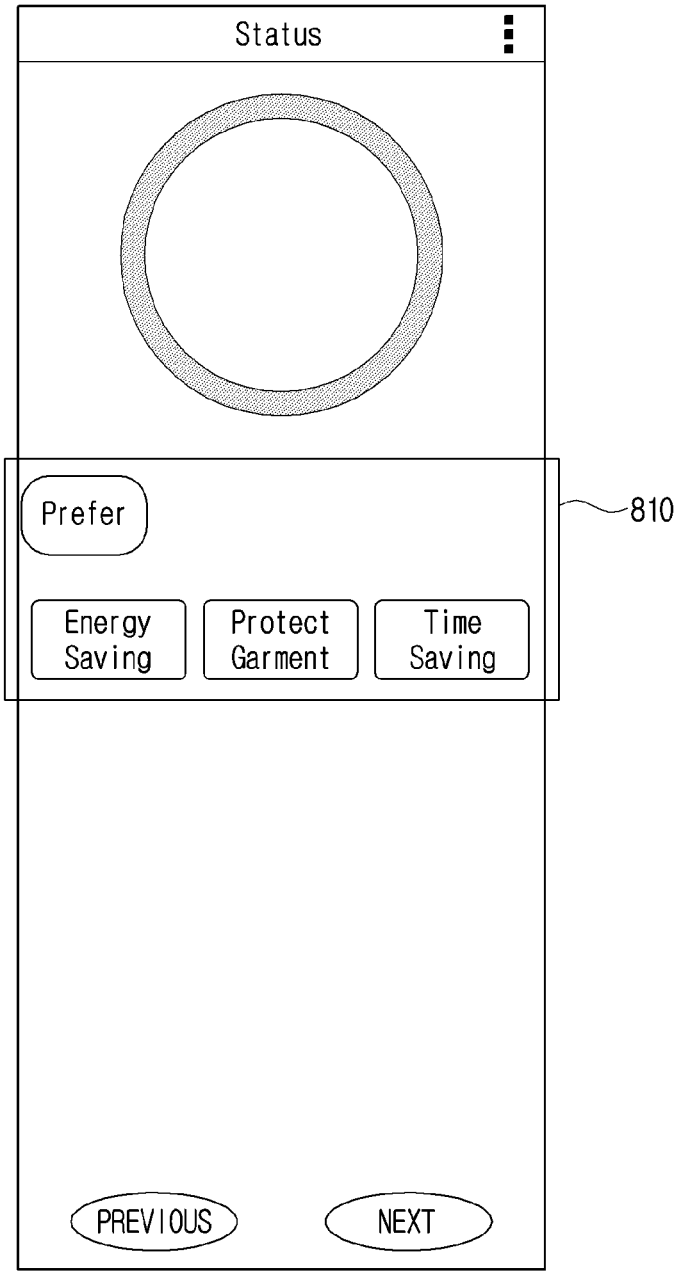
FIG. 8 is a view illustrating a screen for setting a preference condition regarding consumed energy and a damage degree of an object according to an embodiment of the disclosure.

FIG. 8 is a view illustrating a screen for setting a preference condition regarding consumed energy and a damage degree of an object according to an embodiment of the disclosure.

According to FIG. 8, the electronic device 100 may display a UI including an item representing a preference condition regarding consumed energy and a damage degree of an object. The item representing the preference condition 810 may include an 'Energy Saving' item focusing on saving energy spent on treating the object, a 'Protect Garment' item focusing on protecting the object from damage, and a 'Time Saving' item focusing on saving an object treatment time. However, the disclosure is not limited thereto, and various items may be included in the preference condition.

When a command indicating that an input of the preference condition regarding the consumed energy and the damage degree of the object has been completed is input, the electronic device 100 may update the list by removing at least some object treating courses from the list or reordering an order of the plurality of object treating courses on the basis of the chosen preference condition regarding the consumed energy and the damage degree of the object.

For example, in a case where the item regarding saving the consumed energy is chosen, the order of the listed washing courses may be changed by removing a washing course in which a washing time is long and a washing course in which a relatively large amount of washing water is required due to the large number of times of rinsing from the list or giving a low priority to these washing courses.

In a case where the item regarding the damage to the laundry is chosen, the order of the listed washing courses may be changed by removing a washing course in which a dewatering speed is relatively fast from the list or giving a low priority to this washing course.

FIGS. 9A to 9F are views illustrating animation images regarding washing statuses for each washing cycle according to an embodiment of the disclosure.

According to FIGS. 9A to 9F, when a washing course is chosen and washing is started according to the chosen washing course, the electronic device 100 may provide animation images representing washing statuses on the basis of information on washing statuses for each washing cycle. Here, the washing cycle may include a weight sensing cycle of the laundry, a washing cycle for washing the laundry with water in which a detergent is dissolved, a rinsing cycle for rinsing the laundry with clear water, and a dewatering cycle for removing water from the laundry.

Figure 9A:
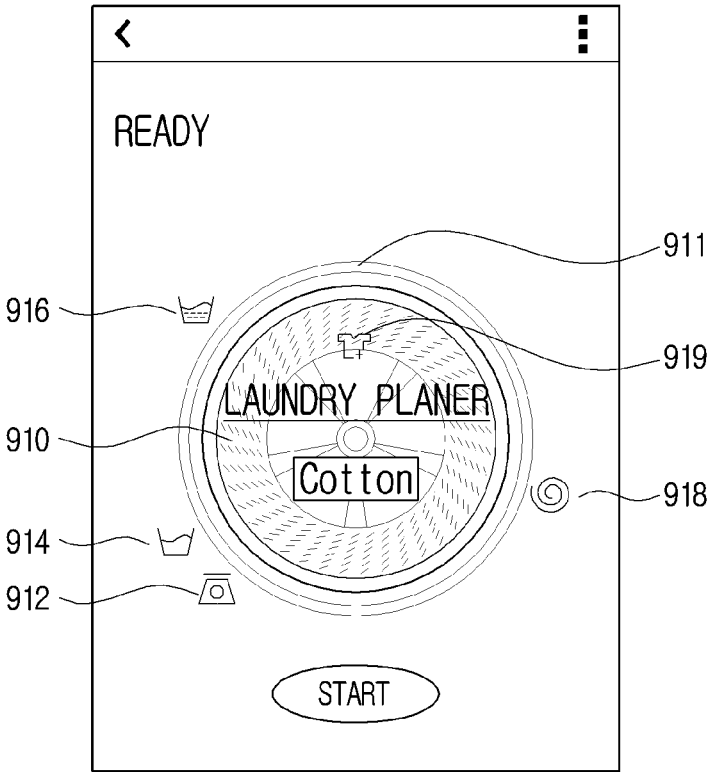
FIGS. 9A to 9F are views illustrating animation images regarding washing statuses for each washing cycle according to an embodiment of the disclosure.

FIG. 9A is a view illustrating a status before a washing operation is started.

According to FIG. 9A, the electronic device 100 may display a visualized circular image 910 of a washing tub. A progress bar 911 representing a washing progress process may have a form in which it surrounds the circular image 910, and icons representing each washing cycle may be displayed on the progress bar 911. Here, the icons representing each washing cycle includes an icon 912 representing the weight sensing cycle, an icon 914 representing the washing cycle, an icon 916 representing the rinsing cycle, and an icon 918 representing the dewatering cycle(Spin). Each icon is in an inactivated status before the washing operation is started, but when the washing operation is started, icons corresponding to each washing cycle may be activated at points in time when each washing cycle is started and be inactivated at points in time when each washing cycle is completed.

The electronic device 100 may display an add wash icon 919 indicating that the washing operation is started and a laundry may be added. The laundry may be added on the basis of at least one of a weight of the laundry or a status of the progressing washing cycle. The electronic device 100 may determine whether or not the laundry may be added on the basis of the weight of the laundry sensed in the weight sensing cycle. In addition, the laundry may be added on the basis of a status of the washing cycle that is currently progressing. For example, the laundry may not be added in a status in which there is foam during the washing cycle. The add wash icon 919 may be displayed only in a case where the addition of the laundry is possible, or may be displayed regardless of whether or not the addition of the laundry is possible, but be activated only in a case where the addition of the laundry is possible. Therefore, the user may add a specific laundry in the rinsing cycle or the dewatering cycle to perform only rinsing or dewatering on the specific laundry, and may directly add a laundry that he/she has forgot after the washing operation is started.

In a case where a condition regarding the washing operation is not input, the electronic device 100 may set a 'Cotton course' as a basic course.

Figure 9B:
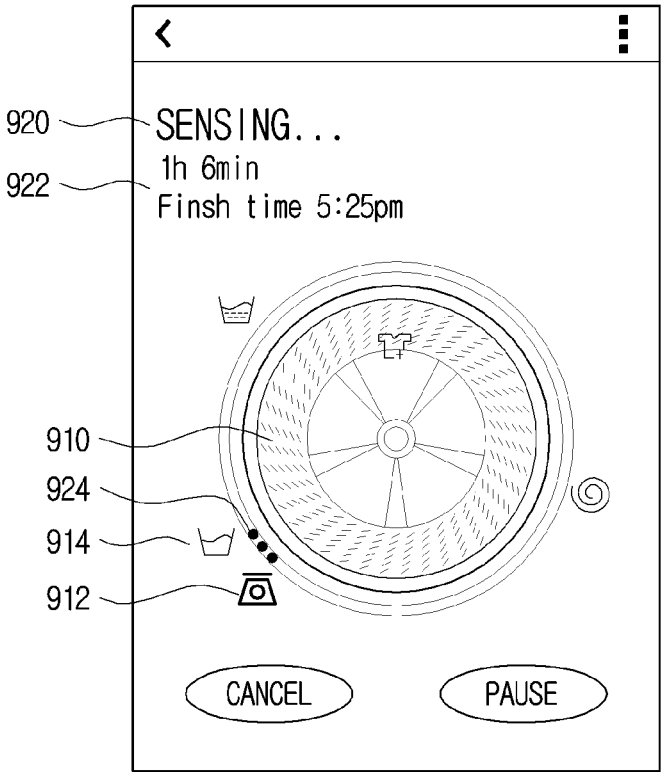

FIG. 9B is a view illustrating a status in which the weight sensing cycle progresses.

The electronic device 100 may display at least one of a time remaining from a current time until the washing is completed or a washing completion time 922 on the display 110. During a period in which the weight sensing cycle progresses, an animation image in which the circular image 910 rotates may be provided, and the icon 912 representing the weight sensing cycle may be activated. In addition, during the period in which the weight sensing cycle progresses, a line 924 inside the progress bar may be displayed to become gradually close to the icon 914 representing the washing cycle to represent a washing progress status.

Figure 9C:
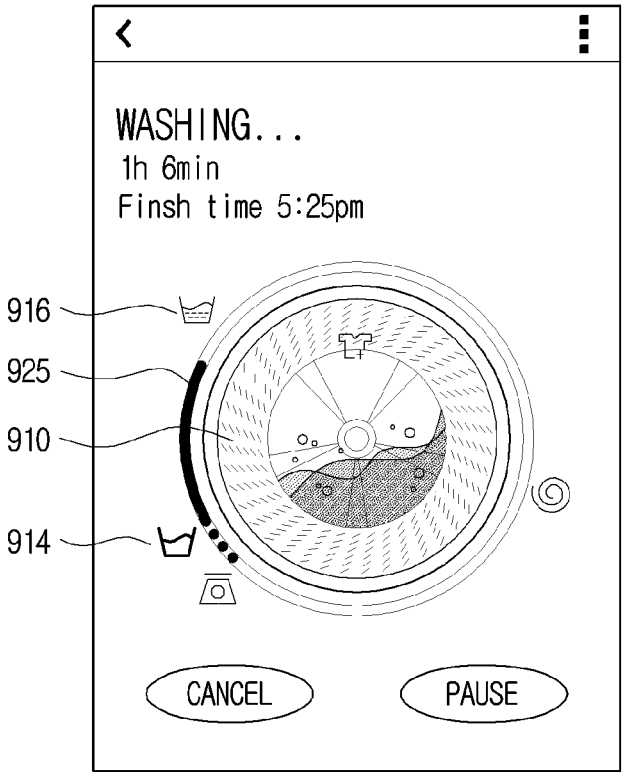

FIG. 9C is a view illustrating a status in which the washing cycle progresses.

During a period in which the washing cycle progresses, an animation image in which washing water and a detergent are provided to and the washing water is filled up in the circular image 910, and the circular image 910 then rotates may be provided, and the icon 914 representing the washing cycle may be activated. In addition, during the period in which the washing cycle progresses, a line 925 inside the progress bar may be displayed to become gradually close to the icon 916 representing the rinsing cycle to represent a washing progress status.

Figure 9D:
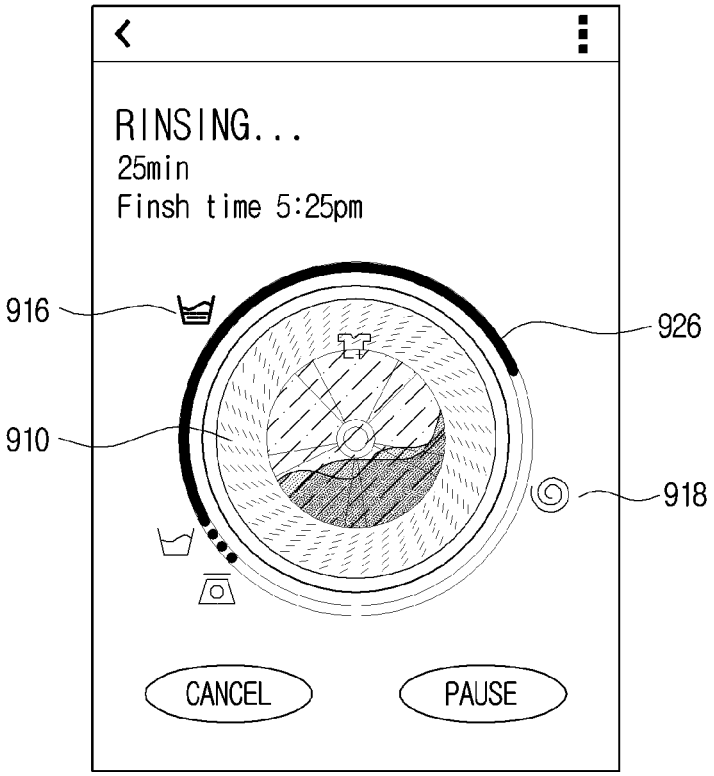

FIG. 9D is a view illustrating a status in which the rinsing cycle progresses.

During a period in which the rinsing cycle progresses, an animation image in which washing water is provided to and is filled up in the circular image 910, and the circular image 910 then rotates may be provided, and the icon 916 representing the rinsing cycle may be activated. In addition, during the period in which the rinsing cycle progresses, a line 926 inside the progress bar may be displayed to become gradually close to the icon 918 representing the dewatering cycle to represent a washing progress status.

Figure 9E:
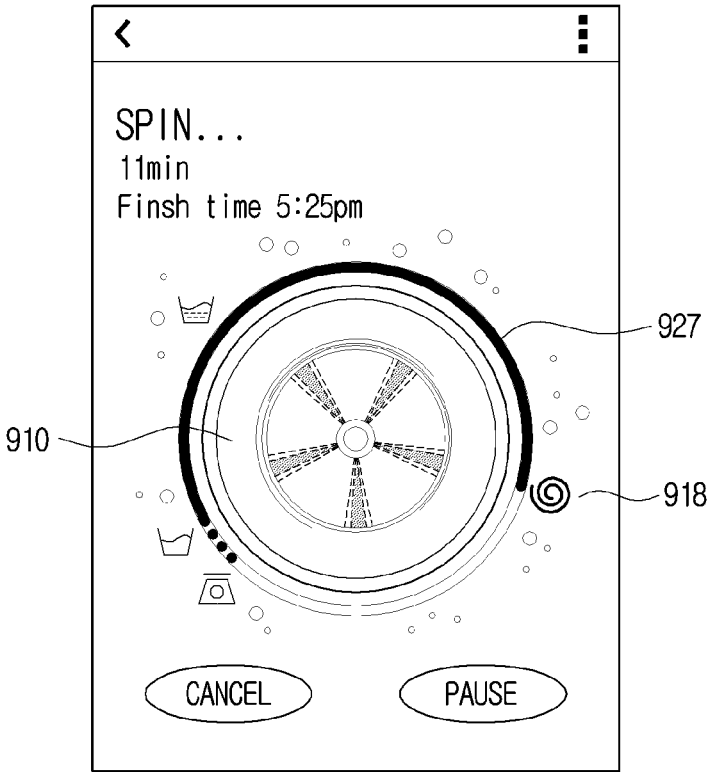

FIG. 9E is a view illustrating a status in which the dewatering cycle progresses.

During a period in which the dewatering process progresses, an animation image in which the circular image 910 rapidly rotates, such that water drops splash out of the circular image 910 may be provided, and the icon 918 representing the dewatering cycle may be activated. In addition, during the period in which the dewatering cycle progresses, a line 927 inside the progress bar may be displayed to become gradually close to a completion point to represent a washing progress status.

Figure 9F:
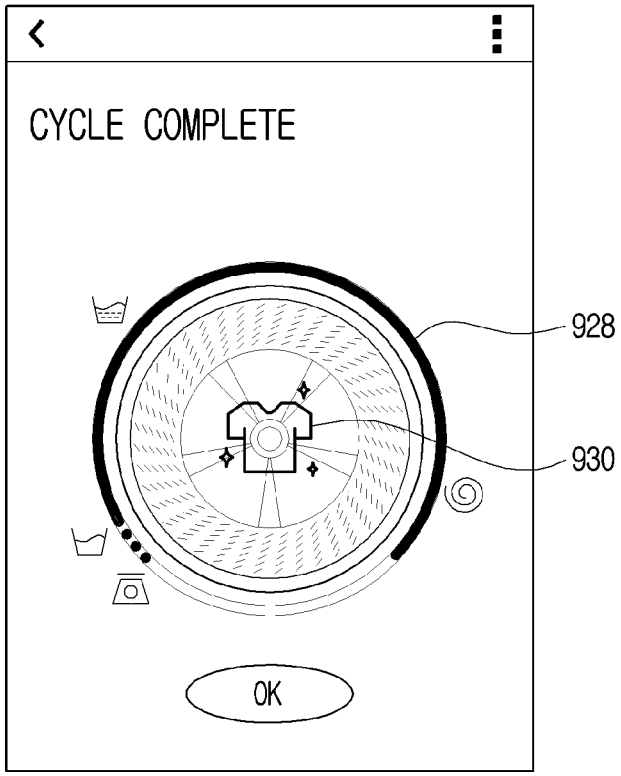

FIG. 9F is a view illustrating a status in which the washing operation is completed.

When the washing operation is completed, a predetermined image may be displayed to indicate that the washing operation has been completed. For example a T-shirt image 930 may be displayed in the circular image 910. In addition, the icons representing each washing cycle may be inactivated, and the time remaining until the washing is completed and the washing completion time may not be displayed. In addition, when the washing operation is completed, a line 928 inside the progress bar may arrive at a completion point of the progress bar to indicate that the washing operation has been completed.

The electronic device 100 may provide different animation images according to the chosen washing course even in the same washing cycle. For example, the electronic device 100 may provide an animation image representing a relatively large amount of washing water in the washing or dewatering cycle in a case of a washing course in which an amount of washing water is large, and provide an animation image representing a relatively fast rotation speed of the washing tub in the dewatering cycle in a case of a washing course in which a dewatering speed is fast.

The electronic device 100 may display an animation image regarding a drying status for each drying cycle. When a drying course is chosen and a drying operation is started according to the chosen drying course, the electronic device 100 may provide animation images representing drying statuses on the basis of information on the drying statuses for each drying cycle Here, the drying cycle may include a drying cycle for drying an object to be dried on the basis of temperature and a blowing cycle for drying the object to be dried on the basis of wind.

For example, the electronic device 100 may provide an animation image representing drying by temperature by displaying a visualized circular image of a drying tub in red or in a flame shape during a period in which the drying cycle progresses, and provide an animation image representing drying by wind by displaying the image of the drying tub in blue or in a wind shape during a period in which the blowing cycle progresses.

The electronic device 100 may provide information informing the user that the object treatment has been completed. For example, the electronic device 100 may provide such information in a form in which vibrations are generated or a specific sound or voice is output. Alternatively, the electronic device 100 may provide such information in a form in which a specific message or image is output on a screen of the electronic device 100 and an auxiliary light emitting diode (LED) is turned on. However, a form in which the electronic device 100 informs the user that the object treatment has been completed is not limited thereto, and may be various.

Figure 10A:
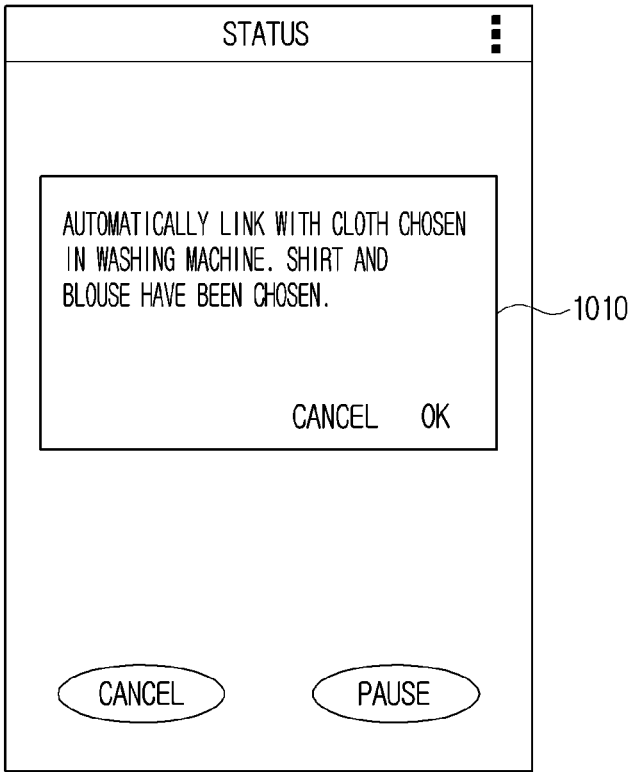
FIGS. 10A and 10B are views for describing an operation of a drying operation on the basis of information input about a washing operation according to an embodiment of the disclosure.
Figure 10B:
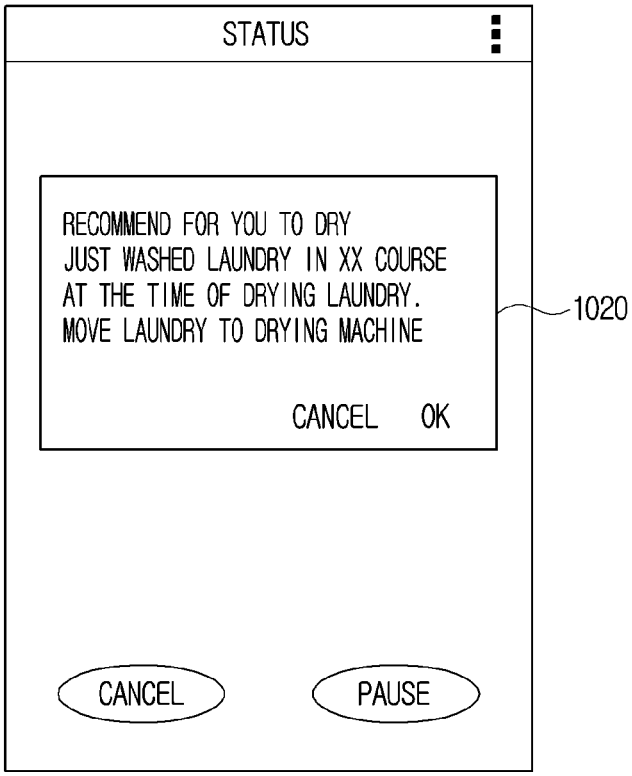

FIGS. 10A and 10B are views for describing an operation of a drying operation on the basis of information input about a washing operation according to an embodiment of the disclosure.

According to FIG. 10A, the electronic device 100 may choose the same kind of object to be dried as that of laundry chosen at the time of the washing operation. For example, in a case where a shirt and a blouse are chosen at the time of the washing operation, the electronic device 100 may provide a UI 1010 of a content indicating that the kind of object to be dried is the same as that of laundry, such as "automatically link with a cloth chosen in a washing machine. A shirt and a blouse have been chosen", to the user. When "OK" is chosen on the UI 1010, the electronic device 100 may provide a UI (UI of FIG. 6A) for receiving a choice of the object in a status where the shirt and the blouse are chosen or may identify that the shirt and the blouse are chosen and may not provide the UI. When 'CANCEL' is chosen on the UI 1010, the electronic device 100 may provide a UI (UI of FIG. 6A) for receiving a choice of the object.

In general, after the washing operation, the laundry included in the washing machine is transferred to and dried in the drying machine, and the laundry and the object to be dried may thus be the same as each other. Also in the object treating device having both of a washing function and a drying function, generally, the laundry and the object to be dried may be the same as each other. Therefore, in an embodiment of the disclosure, inconvenience that the kind of object to be dried is chosen once again may be reduced.

FIG. 10B is a view for describing an operation in which a drying operation course is recommended on the basis of a chosen washing operation course.

When one of the plurality of object treating courses regarding the washing operation is chosen, the electronic device 100 may identify object treating courses regarding the drying operation on the basis of the chosen object treating course. The electronic device 100 may provide a UI 1020 having a content recommending a drying course similar to the chosen washing course. For example, in a case where a duvet washing course is chosen as the washing course, the electronic device 100 may recommend and provide a duvet shaking course similar to the duvet washing course such as "recommend for you to dry a just washed laundry at the time of drying the laundry. Move the laundry to a drying machine". When "OK" button is chosen on the UI 1020, the electronic device 100 may recognize that the duvet shaking course is chosen and may not recommend a separate course. When "CANCEL" button is chosen on the UI 1020, the electronic device 100 may provide one or more courses other than the duvet shaking course.

Figure 11:
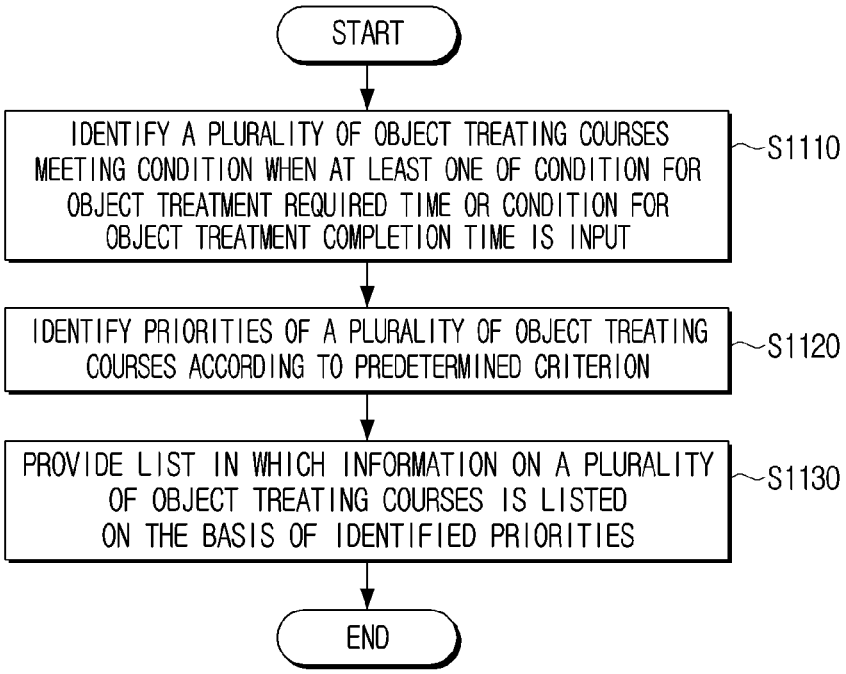
FIG. 11 is a flowchart for describing a method for controlling an electronic device according to an embodiment of the disclosure.

FIG. 11 is a flowchart for describing a method for controlling an electronic device according to an embodiment of the disclosure.

According to FIG. 11, the electronic device 100 may recognize a plurality of object treating courses meeting an input condition when at least one of the object treatment required time and the object treatment completion time is input (S1010). The electronic device 100 may identify priorities of the identified object treating courses according to a predetermined criterion (S1020). Here, the predetermined criterion may be an order in which the object treatment required time is short, an order in which the object treatment required time is long, an order in which an object treating effect is good, or an order in which damage to the object is low, but is not limited thereto.

The electronic device 100 may provide a list in which information on the plurality of object treating courses is listed on the basis of the identified priorities (S1030). Subsequently, when at least one of additional conditions regarding a kind of object, a color of the object, a soil of the object, consumed energy, and a damage degree of the object is input, the electronic device 100 may update the list by changing some of the listed object treating courses on the list on the basis of the input additional condition.

Detailed operations of each step have been described above, and a detailed description thereof will thus be omitted.

The case where the electronic device 100 is implemented by the user terminal device 10 has been described hereinabove, but the electronic device 100 may also be implemented by the object treating device 20 in some cases.

Meanwhile, the diverse embodiments described above may be implemented in a computer or a computer readable recording medium using software, hardware, or a combination of software and hardware. In some cases, embodiments described in the disclosure may be implemented by a processor itself. According to a software implementation, embodiments such as procedures and functions described in the specification may be implemented by separate software modules. Each of the software modules may perform one or more functions and operations described in the specification.

Meanwhile, computer instructions for performing processing operations according to the diverse embodiments of the disclosure described above may be stored in a non-transitory computer-readable medium. The computer instructions stored in the non-transitory computer-readable medium may cause a specific device to perform the processing operations according to the diverse embodiments described above when they are executed by a processor.

The non-transitory computer-readable medium is not a medium that stores data for a while, such as a register, a cache, a memory, or the like, but means a medium that semi-permanently stores data and is readable by the device. A specific example of the non-transitory computer-readable medium may include a compact disk (CD), a digital versatile disk (DVD), a hard disk, a Blu-ray disk, a universal serial bus (USB), a memory card, a read only memory (ROM), or the like.

Although embodiments of the disclosure have been illustrated and described hereinabove, the disclosure is not limited to the abovementioned specific embodiments, but may be variously modified by those skilled in the art to which the disclosure pertains without departing from the gist of the disclosure as disclosed in the accompanying claims. These modifications should also be understood to fall within the scope and spirit of the disclosure.

The invention claimed is:

1. An electronic device comprising:

a display; and a processor configured to identify a plurality of object treating courses meeting an input condition when at least one of a condition for an object treatment required time or a condition for an object treatment completion time is input, identify priorities of the plurality of object treating courses according to a predetermined criterion, and control the display to provide a list in which information on the plurality of object treating courses is listed on the basis of the identified priorities, wherein object treatment is a process of washing or drying an object by at least one of a washing operation or a drying operation.

2. The electronic device as claimed in claim 1, wherein the processor is configured to update the list by removing at least some object treating courses from the list on the basis of an additional condition when the additional condition is input, the additional condition being an additional condition for at least one of a kind of object, a color of the object, or a soil of the object.

3. The electronic device as claimed in claim 1, wherein the processor is configured to update the list by reordering an order of the plurality of object treating courses on the basis of an additional condition when the additional condition is input, the additional condition being an additional condition for at least one of a kind of object, a color of the object, or a soil of the object.

4. The electronic device as claimed in claim 1, wherein the processor is configured to update the list by removing at least some object treating courses from the list or reordering an order of the plurality of object treating courses on the basis of an additional condition when the additional condition is input, the additional condition being an additional condition for at least one of information related to consumed energy or information related to a damage degree of the object.

5. The electronic device as claimed in claim 1, wherein the processor is configured to identify the priorities of the plurality of object treating courses on the basis of object treatment required times of each of the plurality of object treating courses.

6. The electronic device as claimed in claim 1, wherein the processor is configured to provide an animation image representing an object treatment status on the basis of information on the object treatment status when an object treating course is chosen on the list and object treatment according to the chosen object treating course is started.

7. The electronic device as claimed in claim 6, wherein the processor is configured to provide the animation image that includes a progress bar guiding a remaining object treatment required time on the basis of an object treatment required time of the object treating course and an object treating progress time at a current point in time and color information.

8. The electronic device as claimed in claim 1, wherein the processor is configured to provide a summed time of the washing operation and the drying operation according to each object course on the display when the plurality of object treating courses meeting the condition are identified.

9. The electronic device as claimed in claim 1, wherein the processor is configured to identify object treating courses regarding the drying operation on the basis of a chosen object treating course when one of the plurality of object treating courses regarding the washing operation is chosen, and provide a list in which information on the identified object treating courses regarding the drying operation is listed, on the display.

10. The electronic device as claimed in claim 1, wherein the processor is configured to provide a user interface (UI) including items representing kinds of different objects, and provide a guide for adding a kind of object on the basis of a kind of specific object when an item representing the kind of specific object is chosen on the UI.

11. The electronic device as claimed in claim 1, wherein the electronic device is implemented by a user terminal device communicating with at least one of a washing machine or a drying machine performing the object treatment.

12. A method for controlling an electronic device, comprising:

identifying a plurality of object treating courses meeting an input condition when at least one of a condition for an object treatment required time or a condition for an object treatment completion time is input;

identifying priorities of the plurality of object treating courses according to a predetermined criterion; and providing a list in which information on the plurality of object treating courses is listed on the basis of the identified priorities, wherein object treatment is a process of washing or drying the object by at least one of a washing operation or a drying operation.

13. The method as claimed in claim 12, further comprising:

receiving an input of an additional condition for at least one of a kind of object, a color of the object, or a soil of the object; and updating the list by removing at least some object treating courses from the list on the basis of the additional condition.

14. The method as claimed in claim 12, further comprising:

receiving an input of an additional condition for at least one of a kind of object, a color of the object, or a soil of the object; and updating the list by reordering an order of the plurality of obj ect treating courses on the basis of the additional condition.

15. The method as claimed in claim 12, further comprising:

receiving an input of an additional condition for at least one of information related to consumed energy or information related to a damage degree of the object; and updating the list by removing at least some obj ect treating courses from the list or reordering an order of the plurality of object treating courses on the basis of the additional condition.

* * * * *